US008721127B2

(12) United States Patent
Walton

(10) Patent No.: US 8,721,127 B2
(45) Date of Patent: May 13, 2014

(54) LIGHTING APPARATUS WITH REFLECTOR ROTATABLY COUPLED TO AN ADAPTER

(76) Inventor: Randal D. Walton, Reno, NV (US)

( * ) Notice: Subject to any disclaimer, the term of this patent is extended or adjusted under 35 U.S.C. 154(b) by 537 days.

(21) Appl. No.: 12/768,717

(22) Filed: Apr. 27, 2010

(65) Prior Publication Data

US 2010/0207540 A1 Aug. 19, 2010

Related U.S. Application Data

(63) Continuation-in-part of application No. 10/393,816, filed on Mar. 21, 2003, now Pat. No. 7,178,944, and a continuation-in-part of application No. 11/588,959, filed on Oct. 27, 2006, now Pat. No. 7,390,106, and a continuation-in-part of application No. 12/070,712, filed on Feb. 19, 2008, now Pat. No. 7,748,871, and a continuation-in-part of application No. 12/717,051, filed on Mar. 3, 2010.

(51) Int. Cl.
*F21V 7/06* (2006.01)
*H01R 33/00* (2006.01)

(52) U.S. Cl.
USPC ..... 362/296.08; 313/113; 313/318.11; 313/318.12

(58) Field of Classification Search
USPC ..... 313/113, 318.01, 318.02, 318.05, 313/318.11, 318.12; 362/217.05–217.07, 362/296.01, 296.08, 296.1, 310, 341, 514; 439/236
See application file for complete search history.

(56) References Cited

U.S. PATENT DOCUMENTS

| | | | | |
|---|---|---|---|---|
| 1,870,147 | A | 8/1932 | Smelly | |
| D113,550 | S | 2/1939 | Clark | |
| 2,314,103 | A * | 3/1943 | Raizner | 362/217.1 |
| 3,179,792 | A | 4/1965 | Weiss | |
| 3,558,873 | A | 1/1971 | Smith | |
| 4,628,414 | A * | 12/1986 | Ricard | 362/463 |
| 4,683,402 | A * | 7/1987 | Aubrey | 315/56 |
| 5,596,247 | A * | 1/1997 | Martich et al. | 315/56 |
| 5,758,952 | A * | 6/1998 | Getselis et al. | 362/260 |
| 6,033,092 | A | 3/2000 | Simon | |
| 6,068,388 | A | 5/2000 | Walker et al. | |
| 6,291,936 | B1 | 9/2001 | MacLennan et al. | |
| 6,356,700 | B1 | 3/2002 | Strobl | |
| 7,390,106 | B2 | 6/2008 | Walton | |
| 2002/0149931 | A1 | 10/2002 | Chang | |
| 2005/0030750 | A1 * | 2/2005 | Ehmen et al. | 362/260 |

(Continued)

OTHER PUBLICATIONS

Atler, Lloyd, GE Announces High Efficiency Incandescent Light Bulbs. Why?, TreeHugger.com, Feb. 24, 2007, Toronto. Accessed Jan. 26, 2011.

U.S. Patent & Trademark Office, Restriction Requirement, Oct. 4, 2004, U.S. Appl. No. 10/393,816.

(Continued)

*Primary Examiner* — Nimeshkumar Patel
*Assistant Examiner* — Steven Horikoshi
(74) *Attorney, Agent, or Firm* — Mohr Intellectual Property Law Solutions, PC

(57) ABSTRACT

A lighting apparatus including a reflector having a reflective exterior surface partially enclosing an interior space and defining a focal point within the interior space, and a high pressure discharge lamp positioned substantially at the focal point of the reflective exterior surface. In some examples, the high pressure discharge lamp includes an arc tube containing mercury, a metal halide, or sodium. In some examples, the reflective exterior surface extends along a longitudinal axis and curves around the longitudinal axis. In some example, the reflective exterior surface defines an elliptical paraboloid.

12 Claims, 21 Drawing Sheets

(56) References Cited

U.S. PATENT DOCUMENTS

| | | | |
|---|---|---|---|
| 2010/0181892 | A1 | 7/2010 | Walton |
| 2010/0207540 | A1 | 8/2010 | Walton |
| 2010/0246188 | A1 | 9/2010 | Walton |
| 2010/0277922 | A1 | 11/2010 | Walton |
| 2010/0320930 | A1 | 12/2010 | Walton |
| 2011/0012529 | A1 | 1/2011 | Walton |

OTHER PUBLICATIONS

U.S. Patent & Trademark Office, Office Action, Mar. 30, 2006, U.S. Appl. No. 10/393,816.

U.S. Patent & Trademark Office, Final Office Action, Aug. 9, 2006, U.S. Appl. No. 10/393,816.

U.S. Patent & Trademark Office, Notice of Allowance, Oct. 17, 2006, U.S. Appl. No. 10/393,816.

* cited by examiner

Fig. 32A
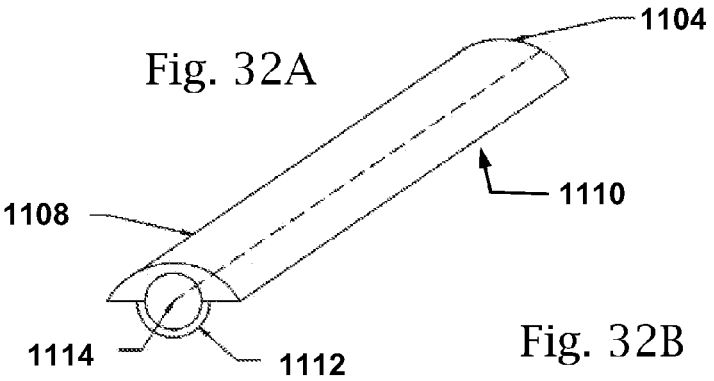
Fig. 32B
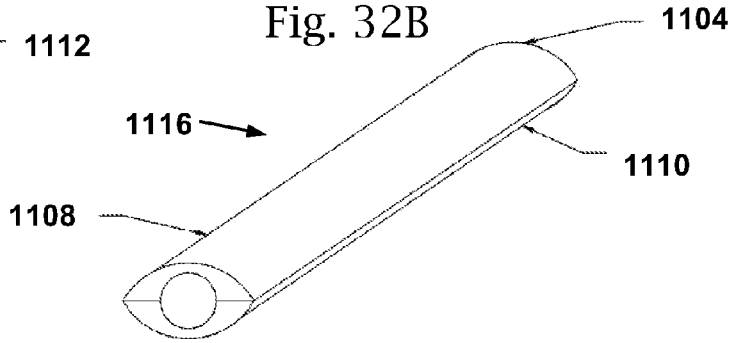
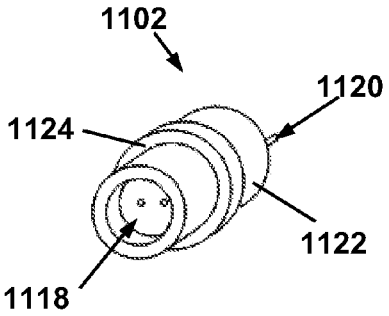
Fig. 33A
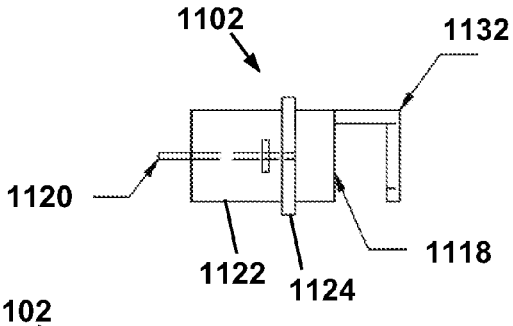
Fig. 33C
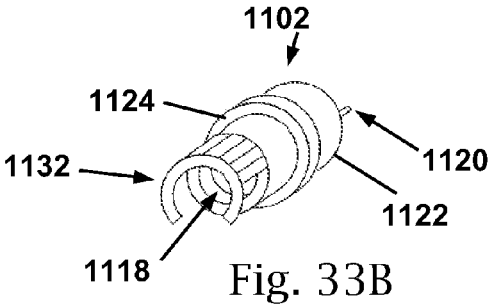
Fig. 33B

LIGHTING APPARATUS WITH REFLECTOR ROTATABLY COUPLED TO AN ADAPTER

CROSS-REFERENCE TO RELATED APPLICATIONS

This application is a continuation-in-part of, and claims priority to, applications Ser. No. 12/717,051, filed Mar. 3, 2010; Ser. No. 12/070,712, now U.S. Patent Application Pub. No. 2008/0232109, filed Feb. 19, 2008; Ser. No. 11/588,959, filed on Oct. 27, 2006, now U.S. Pat. No. 7,390,106; and Ser. No. 10/393,816, filed on Mar. 21, 2003, now U.S. Pat. No. 7,178,944. The disclosures of the cited related applications are incorporated herein by reference in their entirety for all purposes.

FIELD OF THE INVENTION

The instant invention may be considered to be in the field of lighting devices, specifically lamps of high intensity discharge and fluorescent lamps, but not limited thereto.

BACKGROUND OF INVENTION

Many industrial and commercial buildings have the burden of illuminating large areas from standard height as well as from higher than normal ceilings. One solution to this lighting application has been the use of high intensity discharge lamps. Mercury vapor, sodium and other high intensity discharge lamps in commercial applications may consume as much as 400 to 1000 watts, and generate an associated amount of heat, contributing to additional heating, ventilating and air conditioning ("HVAC") operation and fire protection considerations.

These lamps also utilize a certain time duration to warm up and achieve full illumination capability, resulting in time periods with less than desired lighting coverage. Such high intensity discharge lamps are also relatively expensive costing several hundreds of dollars per lamp.

Lamp manufacturers are constantly looking for ways to maximize the amount of foot candles of illumination which can be generated for a fixed amount of power consumption or wattage. These objectives have resulted in the evolution of high intensity discharge lamps which burn metallic vapors to achieve high lumen output.

A fairly common discharge lamp with a reflective lamp is disclosed in U.S. Pat. No. 6,291,936 B, issued Sep. 18, 2001 to MacLennan et al. Summarizing, the MacLennan patent discloses a discharge lamp including an envelope, a source of excitation power coupled to the fill for excitation thereof and thereby emit light, a reflector disposed around the envelope and defining an opening, and a reflector configured to reflect some of the light emitted by the fill back into the fill while allowing some light to exit through the opening. This description is typical of a high intensity discharge lamp. The high pressure sodium lamp emits the brightest light while metal halide and mercury vapor lamps emit about the same amount of light. For a lamp in the 400 W range, for example, a ballast which acts as the excitation for the fill may typically consume 40 to 58 watts.

Fluorescent lamps are also used in commercial applications, often in offices and warehouses where a plurality of fluorescent tubes are positioned in front of a washboard-shaped, mirrored reflector. The purpose of the reflector is to reflect the light emitted upward back down toward the targeted illumination area. Fluorescent lamps differ from high intensity discharge lamps in that the "strike" time (the time to excite the interior of the lamp) is short—almost immediate, where the high intensity discharge lamps must warm up to full illumination. Fluorescent lamps also operate at a cooler temperature than do high intensity discharge lamps. The same approach may be applied to retrofitting existing installations in the commercial office environment.

Fluorescent lamps are also used in residential applications. A growing trend is the replacement of incandescent lamps with fluorescent lamps to achieve not only brighter light, but also savings in power consumption.

Lamps like the Sylvania ICETRON lamp are touted as having a 100,000 hour lamp life, or roughly five times the life of a standard high intensity discharge lamp. Consequently, with such added lamp life, the amount of maintenance required to change lamps in order to maintain illumination is reduced by 80%.

When one examines the shortcomings attendant to the use of high intensity discharge lamps and the advantages of fluorescent lamps, several observations result. By comparison, fluorescent lamps provide crisp white light in comparison to high intensity discharge lamps which offer unpleasant color and distracting color shift. Fluorescent lights may also be flexibly dimmed whereas high inensity discharge lights may not be operated below 50% output.

What is needed is a lamp which can illuminate a target area with the same amount of foot candles as a high intensity discharge lamp without consuming the same amount of energy, without requiring a warm-up period, and in operation generating less heat.

There exists a further need for high intensity discharge lamps which can illuminate a target area with the same amount of foot candles as a higher wattage, high intensity discharge lamp without consuming the same amount of energy.

Also, what is needed is a lamp which can illuminate a target area with the equivalent of foot candles as an incandescent lamp, but without consuming the same amount of energy.

Further, if the illuminating capability of a high intensity discharge lamp could be accomplished without the high capital cost associated with the purchase and operation of such lamps, the relative operating cost of illuminating industrial and commercial buildings would be reduced. The same can be said for the improvement of residential illuminations as well.

If such a lamp as described immediately above were developed, the cost of retrofitting fixtures with such lamps would be paid for relatively quickly by the associated savings from reductions in energy consumption.

One area of the art that remains to be fully developed is the optimal use of reflective surfaces to assist in directing light which would normally travel away from the targeted illumination area.

SUMMARY OF THE INVENTION

The present invention combines the advantages of compact fluorescent light tubes with reflective technology aimed at retrofitting high intensity discharge lamps in industrial and commercial applications. Applicant's invention also combines the advantages of high intensity discharge, incandescent and other light sources with reflective technology aimed at retrofitting each type of lamp for industrial, commercial, and residential applications.

By using a combination of cooler operating fluorescent tube lamps with concentrating reflective surfaces, an equivalent illumination result can be achieved at a reduction in energy consumption in the range of 40% to 74%. As a result of the much lower cost of a compact fluorescent lamp, multiple lamps may be used in combination to generate the equivalent illumination of a target area as that of high intensity discharge lamps.

The present invention utilizes reflective surfaces in a variety of ways to increase the intensity of light delivered to the target illumination area.

First, the lamp glass may be manufactured having a reflective surface to reflect light which would normally emanate away from the target illumination area back toward the target area, thereby increasing the amount of light delivered to said target illumination area ("TIA").

Second, a housing which is normally used for lamps such as a semi-conical or paraboloid-shaped high bay fixture, or a flat "washboard" type reflector may be retrofitted with a combination lamp and reflector which not only uses whatever reflective capability exists in the housing, but adds its own intensity focus factor to deliver light to the TIA, even delivering an equivalent amount of light at much less of a wattage rating (and thereof less power consumption) than the original lamp or lamps in the housing.

In a first embodiment of the present invention, a spiral fluorescent tube is combined with an interior reflector and a single secondary paraboloid reflector. A third reflector such as a semi-conical or paraboloid shape can be utilized by positioning the floodlight fixture at the focal point of said reflector. Important in this case is the distance between the tubes themselves as well as between each tube and its associated reflectors.

The importance stems from the amount of space needed to allow the reflector to bounce light back past the tubes and toward the TIA, and also the space needed for dissipation of heat. Convection allows cool air to be drawn past the fins and dissipating heat will protect the ballast. The compact fluorescent floodlight has a lens designed to precisely control the light from the reflector. It is covered with small, detailed shapes to direct the light into the desired beam pattern. The lens also acts as a cover to allow the lamp to act as it own fixture.

A second embodiment of applicant's invention employs an "implant" consisting of a spirally configured fluorescent or compact fluorescent lamp which is fitted with a reflective surface proximate to the interior portion of the lamp itself. This implant may be retrofitted into a conventional high-bay industrial fixture, thereby delivering an equivalent amount of light to the TIA with less wattage consumed. Each spiral lamp has proximate to it a primary reflector to re-direct light which might otherwise be "lost," meaning not directed to the TIA, and as well, a secondary reflector which helps direct the light to a third reflector which finally directs the focused light to the TIA.

A third embodiment of applicants invention employs a high intensity discharge compact fluorescent lamp consisting of an array of "spirally" configured fluorescent lamps, each fitted with a reflective surface proximate to the interior portion of the lamp itself. This "HID" may be retrofitted into a conventional high-bay industrial fixture, thereby delivering an equivalent amount of light to the TIA with less wattage consumed. As in the case of the second embodiment, each spiral lamp has proximate to it a primary reflector to re-direct light which might otherwise be "lost," meaning not directed to the TIA, and as well, a secondary reflector which helps direct the light to a third reflector which finally directs the focused light to the TIA. This triple reflective light fixture could be placed in a fourth semi-conical or paraboloid shape reflector and can be utilized by positioning the floodlight fixture at the focal point of said reflector to increase the foot candles at the TIA and reduce energy consumption. Fins allow cool air to be drawn in, dissipating heat and protecting the ballast. The compact fluorescent floodlight has a lens designed to precisely control the light from the reflector. It is covered with small, detailed shapes to direct the light into the desired beam pattern, but could also be smooth. The lens also acts as a cover to allow the lamp to act as its own fixture.

In a fourth embodiment, a plurality of spiral lamps having primary reflectors is positioned inside a plurality of secondary reflectors. This array is then positioned inside a single third reflector having its own focusing characteristics, thereby further optimizing the delivery of light to the TIA. Consistent with the applicant's approach, the array is positioned at the focal point of the third reflector.

In a fifth, or preferred embodiment, of the instant invention a light source is positioned at the focal point of a reflective surface which optimizes the amount of light which is directed to the TIA. In this embodiment, a small wattage fluorescent tube is placed inside a second tube having a partially reflective surface and in some cases, a partial lens. An all-in-one open "said" Reflector Lamp can also be used by placing a smaller lamp at the focal point of said reflector. The placement of the smaller fluorescent tube is determined by the focal point of the second outer tube, thereby dependent upon the diameter of the second outer tube.

In a sixth embodiment of the present invention, a U-shaped tube is positioned at the focal point of a reflective surface thereby optimizing the amount of light which is directed to the TIA. Also, in this embodiment, a small wattage fluorescent tube is placed inside another tube or concave, open reflector having a partially reflective surface.

In a seventh embodiment of the instant invention, a high intensity discharge lamp employs a light source at the focal point of a reflective surface again optimizing the amount of light which is directed to the TIA. In this embodiment, a small wattage HID "said invention" Reflector Lamp is placed at the focal point of an outer second reflective surface. The placement of the small light source is again determined by the focal point of the bulb.

In another embodiment, an incandescent lamp employs a light source at the focal point of a reflective surface which optimizes the amount of light which is directed to the TIA. In this embodiment, a small wattage incandescent "same said" Reflector Lamp is placed at the focal point of an outer second reflective surface. The placement of the small light source is determined by the focal point of the bulb.

As one can see, a variety of different shaped lamps can be positioned in the focal point of a reflective surface, even taking advantage of a reflective surface with multiple facets, thereby increasing the amount of light reflected toward the TIA. The placement of the light is typically determined by the focal point of the reflector, thereby dependant upon its diameter. The resultant light delivered to the TIA is consistent with the values expressed in Tables A, B, and C.

The focal point is determined using the formulas developed to describe light reflected from a concave mirror. The equation may be expressed as $f=R/2$, where R is the radius of the mirror (in the case of the preferred embodiment, the outer tube) and f is the focal length, or the distance from the mirror where the light source should be placed for optimal reflection.

Graph 1 shown in FIG. 16 illustrates how the various types of lamps; i.e., fluorescent, halogen, mercury vapor and high pressure sodium compare with one another. As can be seen from the table, the fluorescent bulb has a higher color rendition index, or "CRI" than other lamp media utilizing the same wattage rating of power consumption.

Graph 2 shown in FIG. 17 shows the asymptotic relationship between an object's distance from the focal point of a reflector and the associated magnification.

Summarizing, the embodiments shown herein comprise seven examples of applicant's invention:

First, a compact or fluorescent lamp such as that already available on the open market, be it spiral, U-shaped, or other configuration, is fitted with a conical (or a variety of other shapes such as concave, or a flat washboard) reflector proximate to the exterior of the lamp glass itself. The purpose of the reflector is to redirect light toward the TIA which would normally scatter in all directions. This Reflector Lamp combination may also be used in conjunction with a single secondary reflector in a combination akin to what is commonly referred to as a floodlamp type apparatus. Positioning of the lamp or lamps in said secondary reflectors proximate to the focal points thereof is advantageously employed.

Second, an embodiment comprising a plurality of spiral fluorescent or compact fluorescent lamps each having a primary reflector is positioned inside a secondary reflector at the focal point forming an array. In this embodiment, a third reflector is employed at the focal point to provide additional direction or focusing of light toward the TIA.

The third embodiment utilizes a small fluorescent tube of low wattage placed proximate to the focal point of a larger tube having, in the preferred embodiment, a reflective hemisphere acting as a primary reflector. In this configuration, light may be directed with substantial increased intensity to the TIA, and when used with a secondary reflector, may provide even more intensity to the TIA.

The fourth embodiment utilizes the amount of space needed for reflector and tubes to allow cool air to flow past the space between reflector and tubes as heat dissipates. Fin spacing allows cool air to pass the fins thereby dissipating heat. Over heating will deteriorate lamp life of the fluorescent ballast.

A fifth embodiment of applicant's invention comprises, the compact fluorescent floodlight with a lens designed to precisely control the light emanating from the reflector. Although it could be smooth, the lens is covered with small, detailed shapes to direct the light into the desired beam pattern. The lens also acts as a cover to allow the lamp to act as its own fixture.

A sixth embodiment of applicant's invention comprises, high-intensity discharge lamps with a light emitting source at the focal point of a reflective surface which optimizes the amount of light directed to the TIA. High pressure sodium is one of the most efficient HID sources available today. These lamps are used for general lighting applications where high efficiency and long life are desired while color rendering is not critical. Typical applications include street lighting, industrial hi-bay lighting, parking lot lighting, building floodlighting and general area lighting. The placement of the small light emitting source is determined to be at the focal point of the reflective hemisphere of the outer tube, thereby being determined by said outer tubes diameter.

A seventh embodiment of applicant's invention comprises incandescent lamps with a light emitting source at the focal point of a reflective surface, which optimizes the amount of light directed to the TIA. The placement of the small light emitting source is determined to be at the focal point of the reflective hemisphere of the outer tube, thereby being determined by said outer tubes diameter.

BRIEF DESCRIPTION OF THE DRAWINGS

FIG. 32A is an embodiment of a reflector of a lighting module according to the present disclosure.

FIG. 32B depicts the reflector frame shown in FIG. 32A coupled to an envelope or lens.

FIGS. 33A, B, and C are embodiments of an adapter for a lighting module according to the present disclosure.

DETAILED DESCRIPTION OF THE INVENTION

Figure 1:
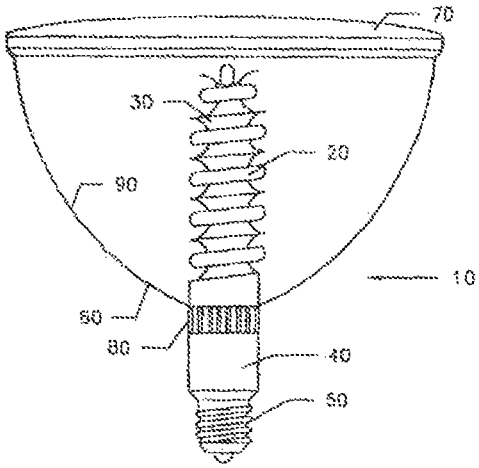
FIG. 1 is a side view of the first embodiment showing a spiral compact fluorescent tube at the focal point of a primary reflector proximate thereto and positioned at the focal point of a secondary reflector, in a configuration commonly referred to as a "floodlight;"

As seen in FIG. 1, a flood light 10 comprises a spiral compact fluorescent lamp 20 around which a primary reflector 30 is positioned. A first bonding means, such as glue or other adhesive or mechanical means is employed to fix lamp 20 and primary reflector 30 in a predetermined position. Lamp 20 is constructed in accordance with typical fluorescent lamps, comprising phosphor coating applied to the inside of the tube with hot cathodes at each end of the lamp. Air is exhausted through the exhaust tube during manufacture and an inert gas is introduced into the bulb. A minute quantity of liquid mercury is included with gas, the gas is usually argon. The stem press has lead-in-wires connecting the base pins and carry the current to and from the cathodes and the mercury arc. Reflector 30 may be fashioned from a variety of materials including but not limited to chrome-plated glass, chrome-plated metal, polished or painted aluminum plate, painted glass, and painted plastic with a variety of reflective coatings. When utilizing molded metal for reflector 30, "mirro 4," "mirro 27" or white reflective aluminum may be selected. Commonly configured, a ballast housing 40, contains a ballast of either electrical or magnetic type, said ballast having a connecting means for electrical connection to lamp 20 and screw plug 50. A second bonding mean is necessary to attach housing 40 to lamp 20. While a bonding means in specified, other means, mechanical or otherwise, may be employed. In addition, ballast housing 40 and screw plug 50 could be fashioned as one unit rather than as separate structures, said unit having either glass, plastic, ceramic or other typical construction known in the art. The area of ballast housing 40 through screw plug 50 is typically fashioned from brass. A secondary reflector 60 in combination with a lens 70 encloses the lighting apparatus. Lens 70 can be made of glass or plastic. Fins 80 are provided on ballast housing 40 to assist in the dissipation of heat.

Secondary reflector 60, in the preferred embodiment, is of paraboloid shape, with its inner surface having a reflective coating 90 said reflector may be fashioned typically from glass, plastic, or metal.

Figure 2:
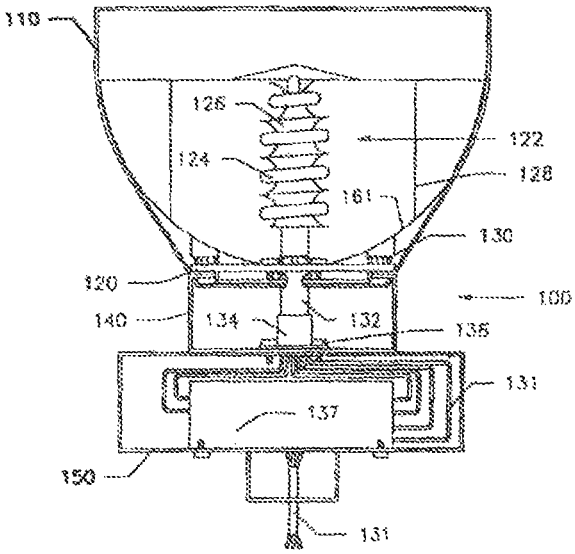
FIG. 2 is a side view of the second embodiment of applicant's invention, disclosing a plurality of spiral fluorescent tubes having primary reflectors positioned as an array and having also secondary reflectors, said array positioned in a third reflector each at its focal point.

FIG. 2 discloses an embodiment 100 of applicant's invention which is primarily employed as a retrofit of existing high bay fixtures. The common housing 110 provides a dual function as a support for a frame 120, said frame fashioned to hold an array 122 of fluorescent lamps 124 having primary reflectors 126. Array 122 further comprises a secondary reflector 128 commonly of assembled sections. Assembled sections are put into third reflector 161. Electrical connections 130, to which electrical wires 131 are attached, are positioned below frame 120 and are fed through a platform 132 and through a transition piece 134, to a fastening means 136. Fastening means 136 fixes secondary housing 140 and therefore housing 110, to a ballast housing 150, through which the electrical wires 131 again pass. These electrical wires may be hard wired to a lighting circuit.

When utilizing embodiment number two for retrofitting a typical high bay fixture such as that disclosed in U.S. Pat. No. 6,068,388 (See sheet 1 of 6), the capacitor and igniter in part 12 are replaced with a ballast. The wiring is kept along with the structure there above. The core and coil which housed in the space adjacent to part 12 is removed. Part 12 may be then fastened to secondary housing 18, each of which can be utilized in addition to reflector 21. All other numbered parts are replaced by those items listed above and below and shown in FIG. 2 and FIG. 3.

A typical high bay fixture can be retrofitted, the capacitor and igniter are replaced with an appropriate capacitor and igniter for a lower wattage high pressure sodium, metal halide, or mercury vapor lamps. The wiring is kept along with the structure thereabove. The core and coil which is housed in the space adjacent to part 12 shown above in U.S. Pat. No. 6,068,388 is replaced with the appropriate core and coil for the lower wattage lamp. All other numbered parts are replaced by those items listed below as shown in FIG. 2 and FIG. 3.

Figure 3:
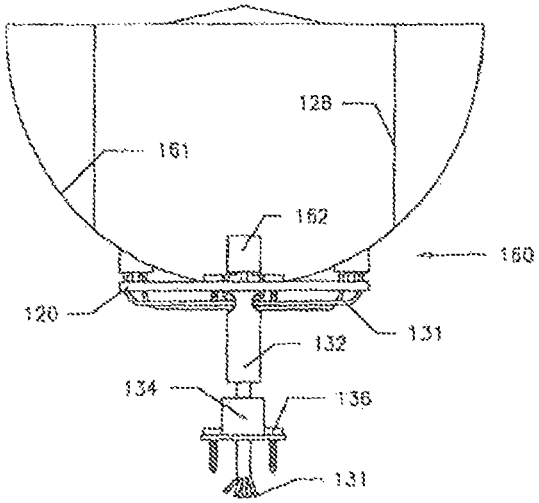
FIG. 3 is a side view of the aforementioned "implant," which may be utilized with a variety of light sources such as the spiral fluorescent tube with primary reflector and beyond, and which may be used to retrofit existing high bay fixtures.
Figure 4:
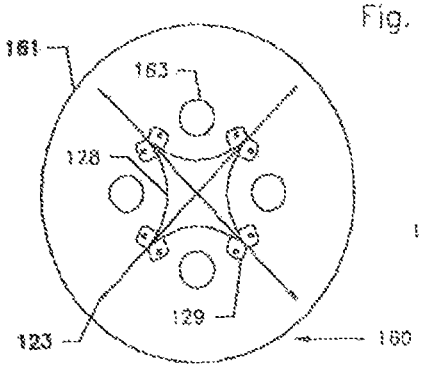
FIG. 4 is a top view of the invention of FIG. 3, further showing the orientation of secondary and third reflectors.

FIG. 3 discloses "implant" 160, described above, provided also with a third reflective mirror-like surface 161. The third reflector could also be used as a secondary reflector 161 in cases where existing technology lamps are used. The implant may be set into an existing high bay enclosure for retrofitting. The height of the implants third reflector depends on condition of reflector 110. Light sockets 162 are provided to accept lamps or other light sources as previously described, and are typically of ceramic construction. As seen in FIG. 4, access holes 163 are provided in reflector 161, allowing for the installation of light source 122, also facilitating the passage of air through holes 163.

Figure 5:
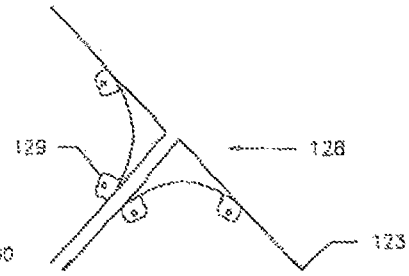
FIG. 5 is a top view of the secondary reflector of the invention disclosed in FIG. 3.

FIG. 5 further discloses secondary reflector 128, and tabs 129, used to fasten the reflector to reflector 161 of FIG. 4, typically by rivets or equivalent means. Folded metal slips 123 slip reflectors 128 together.

Figure 6:
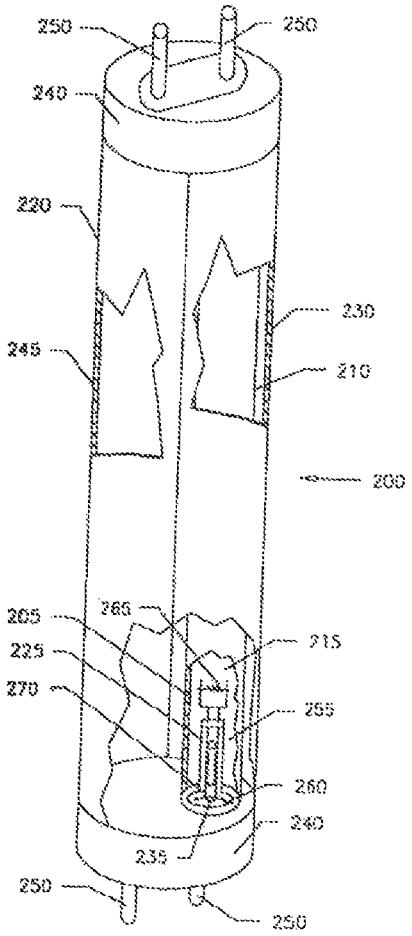
FIG. 6 is a side view of the fifth embodiment of applicant's invention, disclosing a smaller fluorescent tube proximate to the focal point of a larger cylindrical enclosure having a reflective hemisphere and manufactured as one piece.

FIG. 6 shows what appears on the surface to be a standard fluorescent tube. However, FIG. 6 depicts a lighting apparatus 200, which comprises a first fluorescent tube 210. First fluorescent tube may include a bulb 255 with Phosphor coating inside the bulb 255. Cathodes 265 at each end of lamp are coated with emissive materials which emit electrons. Air is exhausted through a tube 270 during manufacture and a minute quantity of liquid mercury 205 is place in the bulb to furnish mercury vapor. Gas 215, usually comprises Argon or a mixture of inert gases at low pressure, but Krypton is some-times used. Stem Press 225 includes lead-in wires that have an air tight seal here and are made of specific wire to assure about the same coefficient of expansion as the glass. Lead-in wires 235 connect to the base pins and carry the current to and from the cathodes and the mercury arc. The first fluorescent tube 210 housed in a larger cylindrical housing 220. Housing 220 is usually a straight glass tube, but may also be circular or U-shaped, and may be made of plastic, glass or other suitable material. Housing 220 has a reflector 230, at the focal point of which is located tube 210, serving as a primary reflector. Several different types of base 240 used to connect the lamp to the electric circuit and to support the lamp in the lamp holder serve to position tube 210 in proper position in housing 220, and further provide penetrations whereby pins 250 may be in electrical contact with the circuitry 260 of tube 210. Of course, the primary reflective surface of reflector 230 is provided on the inside or outside of housing 220, which provides reflective capability for light emitted from tube 210. Lens 245 may be smooth, but could be designed to precisely control the light from the reflector. It is covered with small, detailed shapes to direct the light into the desired beam pattern. The lens also acts as a cover to allow the lamp to act as it own fixture. A common material for lens 245 can be glass or plastic or other suitable materials. Reflector 230 could also not be enclosed to save on material costs.

Lighting apparatus 200 depicted in FIG. 6 may be manufactured as one unit or the different elements of lighting apparatus 200 may be used separately with an adapter. The benefit of these separate elements is that standard "T5" units or equivalent fluorescent lamps can be replaced, but the other parts will continually last and not need replacement.

For example, base 240 and pins 250 may be in electrical contact with the circuitry of a tombstone. The tombstone positioned at the focal point of the base hemisphere 240 can hold the smaller pins used in T5 fluorescent lamps. Several different types of lamp pins maybe used to connect lamp 210 and the tombstone. Common materials for the adaptor tombstone, pins, and connectors could be metal, ceramic, plastic, or the equivalent.

Housing 220 of FIG. 6 may be provided in a number of suitable configurations, including a larger cylindrical housing. Housing 220 has a reflector 230 with lens cover 245. Some common materials that could be used for housing 220 may be glass or plastic, or other suitable materials commonly employed in the art.

The fluorescent tube may also be combined with bases 240, pins 250, and fluorescent tube 210 as one unit.

Additionally or alternatively, lighting apparatus 200 may include enclosure caps and end caps with slots to hold pins 250 in place. Lighting apparatus 200 may also be employed in a secondary reflector, such as a wash board type reflective housing, thereby giving additional reflective assistance in delivering light to a target illumination area.

In lighting apparatus 200 depicted in FIG. 6 and disclosed hereinabove, standard type electrical connections including ballasts, sockets, and standard wiring are employed. Applicant's invention focuses primarily on the reflective aspects of providing additional light to a TIA, resulting in more lighting where desired with conservation of energy.

Figure 6A:
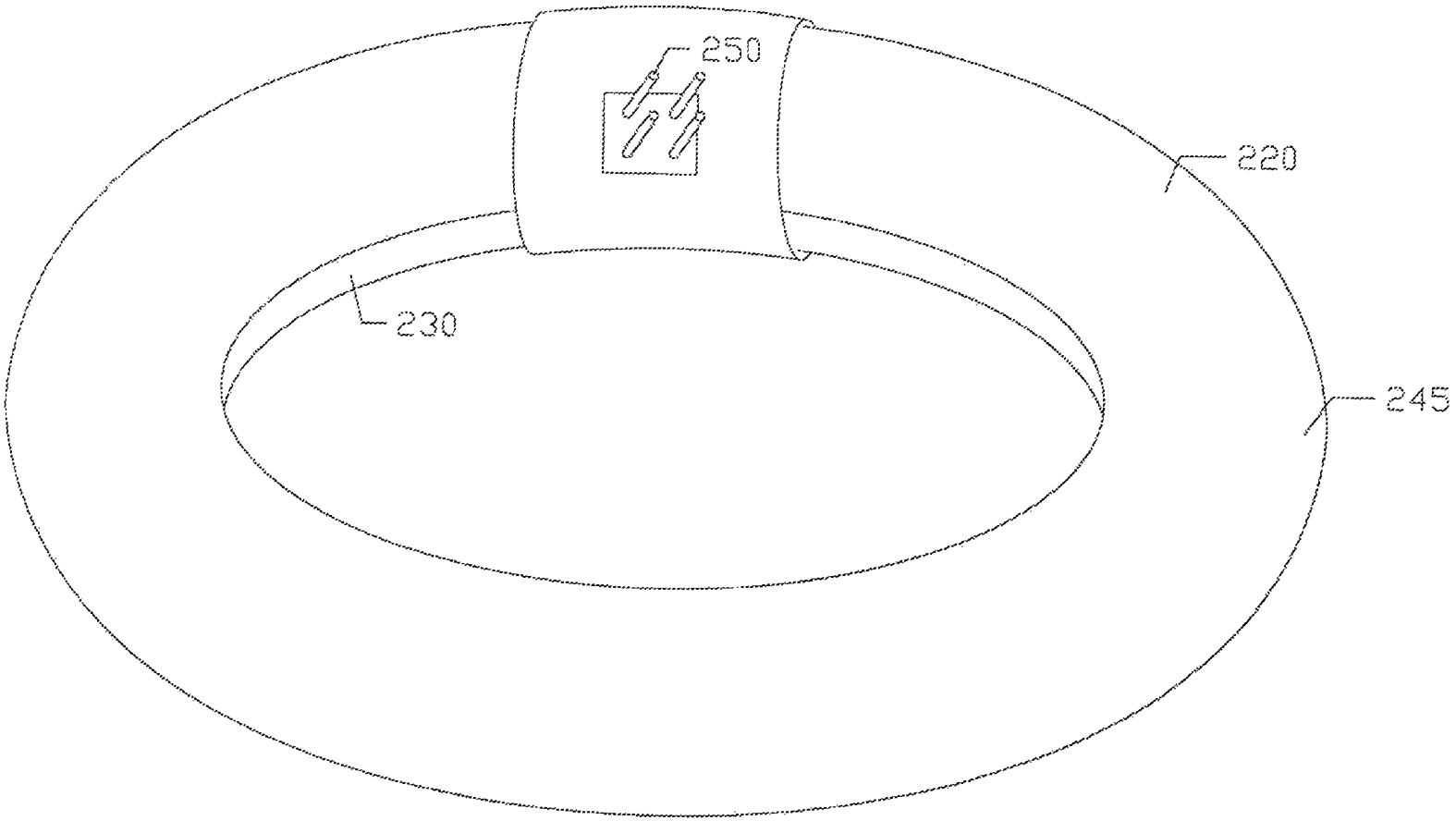
FIG. 6A is a side view of the lighting apparatus of FIG. 6 having a tubular housing of a circular shape.
Figure 6B:
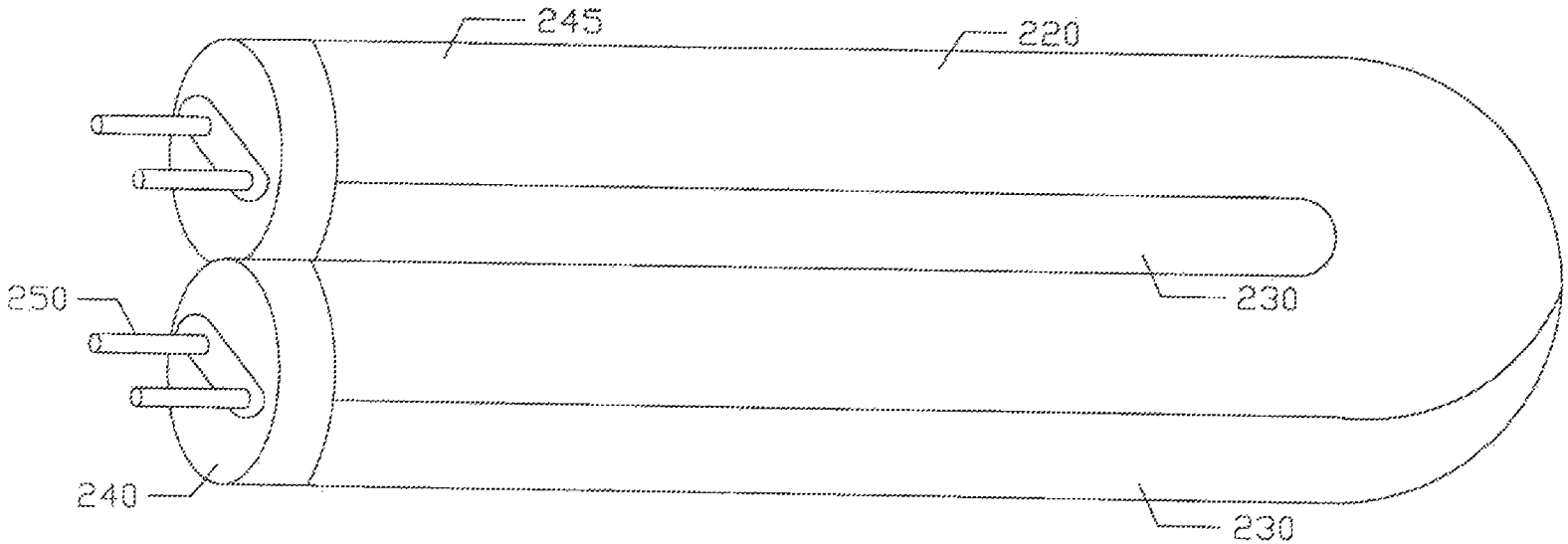
FIG. 6B is a side view of the lighting apparatus of FIG. 6 having a tubular housing of a U-shape.

FIGS. 6A and 6B depict the housing 220 shown in FIG. 6 in circular and U-shapes, respectively, as discussed above.

Figure 7:
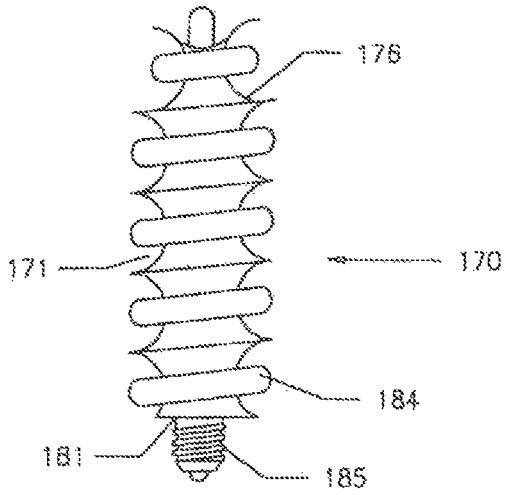
FIG. 7 is a side view of the aforementioned spiral compact fluorescent or fluorescent lamp, disclosing a smaller fluorescent spiral tube proximate to the focal point of a larger concave spiral reflector.

FIG. 7 discloses spiral compact fluorescent (or fluorescent lamp) 170 comprising a spiral compact fluorescent lamp 184 around which a primary reflector 176 is positioned. A first bonding means, such as glue or other adhesive or mechanical means is employ to fix lamp 184 and primary reflector 176 in a predetermined position. Ballast housing 181 for compact fluorescent lamp (or no ballast housing 181 for fluorescent lamp without ballast). In addition, housing 181 and screw plug 185 could be fashioned as one unit rather than as separate structures. Also air space 171, as heat dissipates cool air is drawn into space 171 cooling housing 181 and reflector 176.

Figure 8:
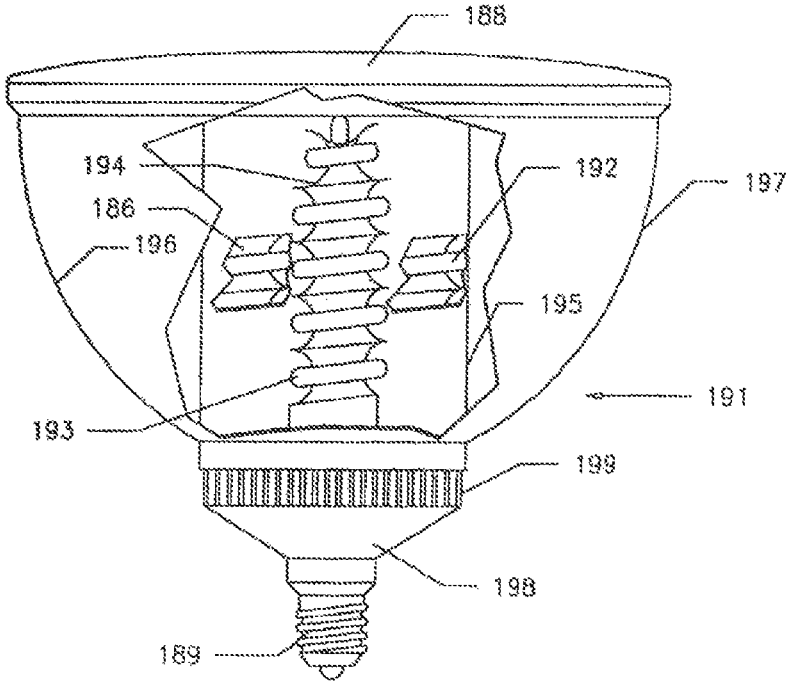
FIG. 8 is a side view of the aforementioned "HID" compact fluorescent lamp with an array of spiral fluorescent tubes with primary, secondary and third reflectors in a configuration commonly referred to as a "floodlight;"

FIG. 8 discloses the "HID" fluorescent lamp 191, of applicant's invention which is primarily employed as a retrofit of existing high bay fixtures. HID fluorescent lamp 191 holds an array 192 of fluorescent lamps 193 having primary reflectors 194. The array 192 further comprises a secondary reflector 195 commonly of assembled sections or one molded piece slips into a third reflective mirror-like surface 196 which is coated with a reflective material. The paraboloid shape housing 197 is made up of material like glass or plastic or other suitable equivalents. A variety of reflective materials may be used for reflectors 194, 195, and 196 including but not limited to chrome-plated glass, chrome-plated metal, polished or painted aluminum plate, painted glass, and plastic painted with a variety of reflective coatings. When utilizing molded metal for reflectors 194, 195, and 196 "mirro 4", "mirro 27" or white reflective aluminum may be selected. A first bonding means, such as glue or other adhesive or mechanical means is employed to fix lamp array 192 and primary reflector array 186 in a predetermined position relative to secondary 195 and third 196 reflectors housing. Commonly configured, a ballast housing 198, contains a ballast of either electrical or magnetic type, said ballast having a connecting means for electrical connection with lamp 193 and screw plug 189. A second bonding means is necessary to attach housing 198 to housing 197. Fins 199 are provided on ballast housing 198 to assist in dissipation of heat. A smooth lens 188 or a lens 188 designed to precisely control the light from the reflector is provided. Lens 188 covered with small, detailed shapes to direct the light into the desired beam pattern. The lens also acts as a cover to allow the lamp to act as its own fixture.

Figure 9:
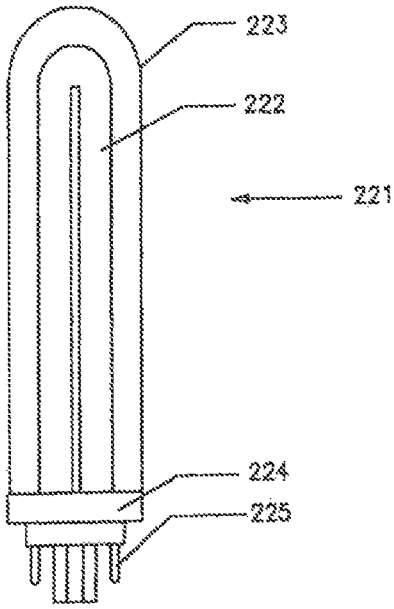
FIG. 9 is a side view of the invention, disclosing a smaller U-shaped fluorescent tube proximate to the focal point of an enclosed partially reflective tube or concave open reflector.

FIG. 9 shows a U-shaped fluorescent lamp 221 with tube 222 in a predetermined positioned of reflective surface 223. Tube 222 and reflector 223 are bonded to base 224 by glue or other mechanical means. Pin 225 and base 224 can be manufactured as one unit or as separate pieces. Many types of base 224 are used on the open market.

Figure 10:
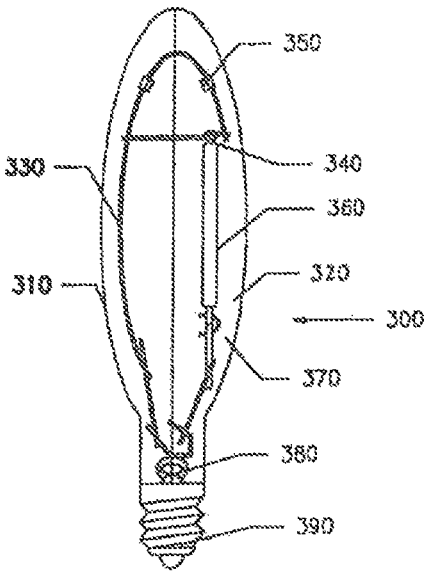
FIG. 10 is a side view of the invention, disclosing the HID high pressure sodium lamp with part of the glass envelope having reflective surface.

FIG. 10 discloses a high pressure sodium Lamp ("HPS") 300 comprising a glass envelope 310 having a substantially concave reflective surface 320. An arc tube 340, with hermetic end seal 360, typically an alumina arc tube or equivalent, is located proximate to the focal point of reflector 320 via a frame 330, usually steel. A residue gas repository 380 is positioned in lamp 300 on a base 390, where it is affixed in its location, and serves to support frame 330. Brass base 390 secures lamp 300 to a suitable light fixture and connects the light fixture's electric circuitry to the lamp. This lamp is made up of glass, metals, or other suitable materials commonly employed in the art.

Figure 11:
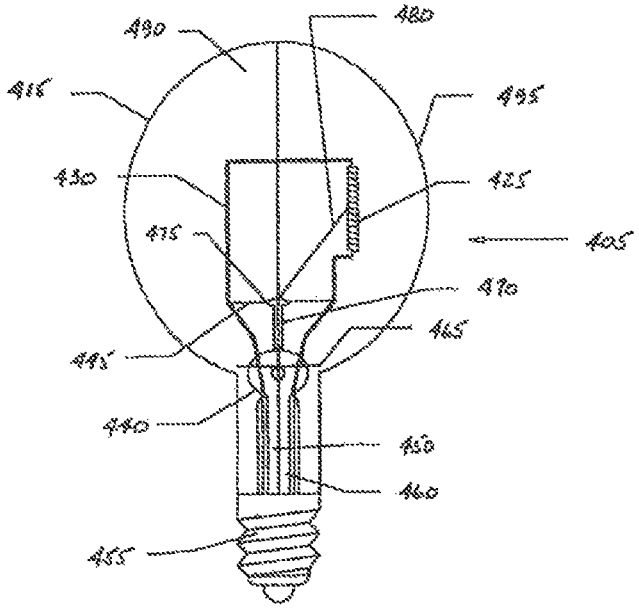
FIG. 11 is a side view of the invention, disclosing an incandescent lamp with part of the glass bulb as a reflective surface.

FIG. 11 shows an incandescent lamp 405 comprising a soft glass envelope 415. Filament 425, generally tungsten is electrically connected by wires 430 to a glass stem press 440. Wires 430 are made typically of nickel-plated copper or nickel from stem press 440 to filament 425. Tie wires 445 support wires 435 in the largest envelope area. Wires 430 pass through stem press 440, and an air evacuation tube 450 toward a base 455. In this stem press area, wires 430 transition from nickel-plated copper or nickel to a nickel-iron alloy core and a copper sleeve (Dumet wire). In this area, there exists an air tight seal at the termination of tube 450, said wires' material change made to assure about the same coefficient of expansion of the wires as the glass, and air exhaust tube 450. Base 455 is made of brass or aluminum. A fuse 460 protects the lamp and circuit if filament 425 arcs. A heat deflector 465 is used in higher wattage general service lamps and other types when needed to reduce circulation of hot gases into neck of bulb.

Glass button rod 470 projects from stem press 440 and supports button 475. Button 475 has affixed thereto support wires 480 and 485. Gas 490 a mixture of nitrogen and argon is used in most lamps 40 watts and over to retard evaporation of the filament 425. A coating is applied to glass envelope 415, creating a substantially sphere-shaped reflective surface 495. Filament 425 is located proximate to the focal point of surface 495. The lamp is made of material like glass or plastic or other suitable equivalents.

Figure 12:
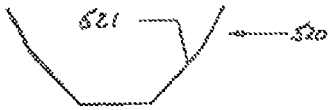
FIG. 12 is a side view of the aforementioned "reflector", disclosing a concave reflector.

FIG. 12, discloses reflector 500, a concave reflector 501, made of a variety of reflective materials including but not limited to chrome-plated glass, chrome-plated metal, polished or painted aluminum plate, painted glass, and plastic painted with a variety of reflective coatings. When utilizing molded metal for reflector 500 "mirro 4", "mirro 27" or white reflective aluminum may be selected or other suitable equivalents.

Figure 13:
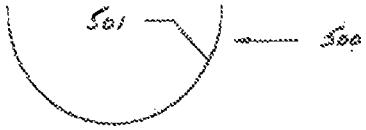
FIG. 13 is a side view of the aforementioned "reflector", disclosing a W-Shape reflector.

FIG. 13, discloses reflector 510, a W-shape reflector 511, again fashioned from a variety of reflective materials as mentioned in FIG. 12.

Figure 14:
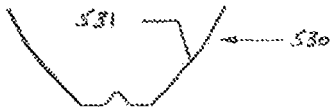
FIG. 14 is a side view of the aforementioned "reflector", disclosing a wash board reflector.

FIG. 14, discloses reflector 520, and a wash board shape reflector 521, again made from a variety of reflective materials as mentioned in FIG. 12.

Figure 15:
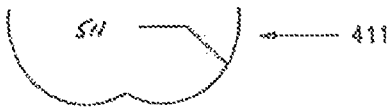
FIG. 15 is a side view of the aforementioned "reflector", disclosing a wash board shaped reflector.

FIG. 15, discloses reflector 530, and a wash board shape reflector 531, both made from a variety of reflective materials as mentioned in FIG. 12.

Figure 16:
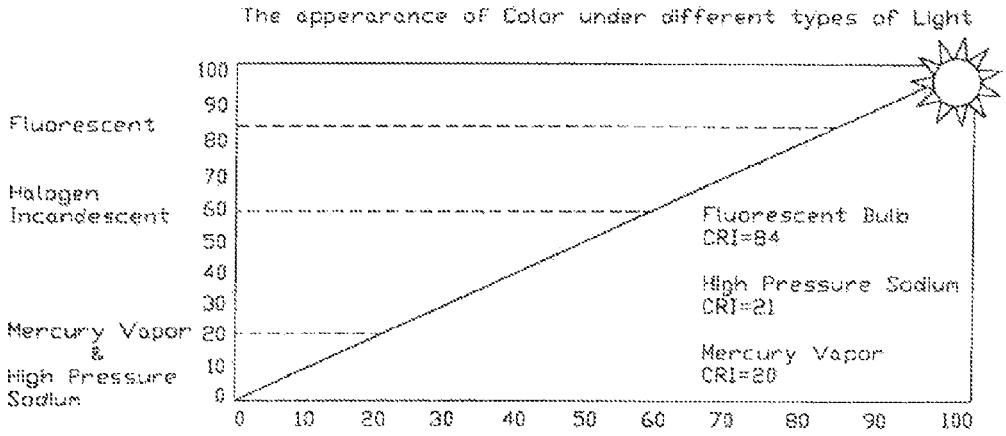
FIG. 16 is a graph showing the appearance of color under different types of light.

FIG. 16 is a graph showing the appearance of color under different types of light.

Figure 17:
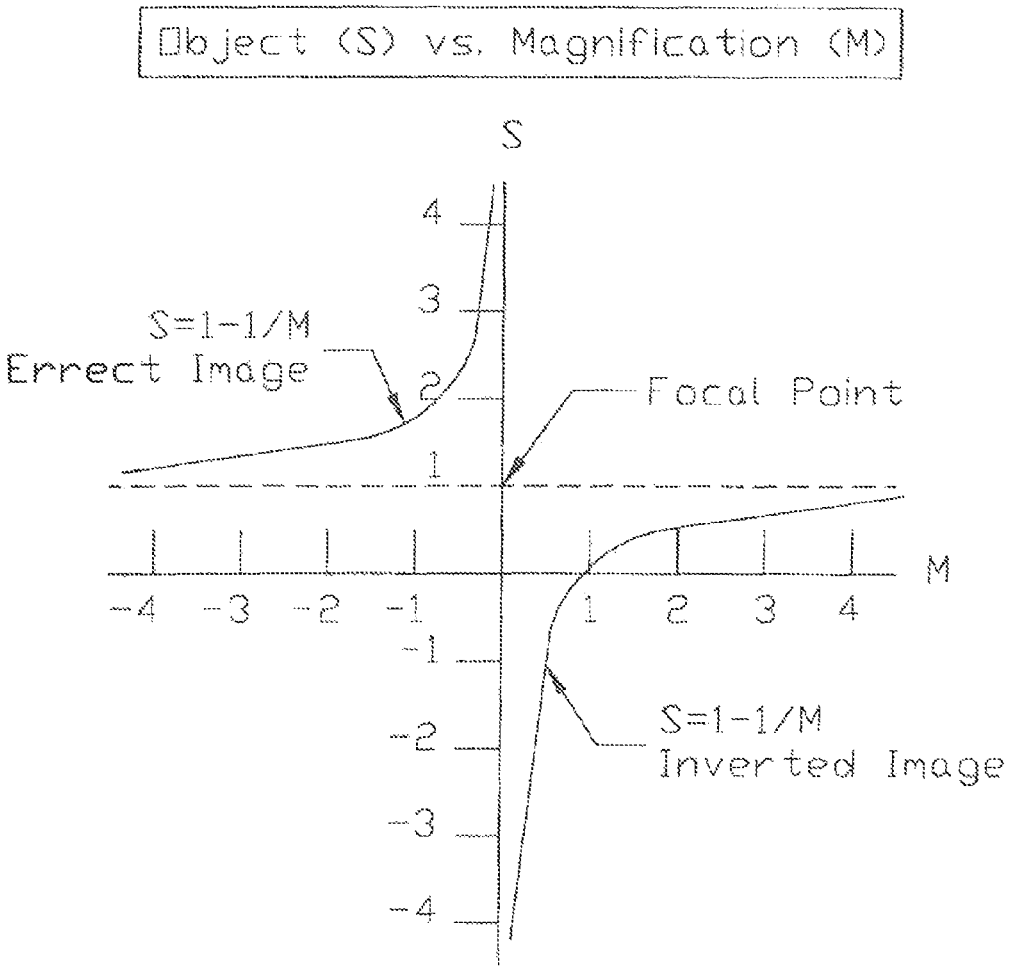
FIG. 17 is a graph showing the relationship between an object and magnification.

FIG. 17 is a graph showing the relationship between an object and magnification.

Figure 18:
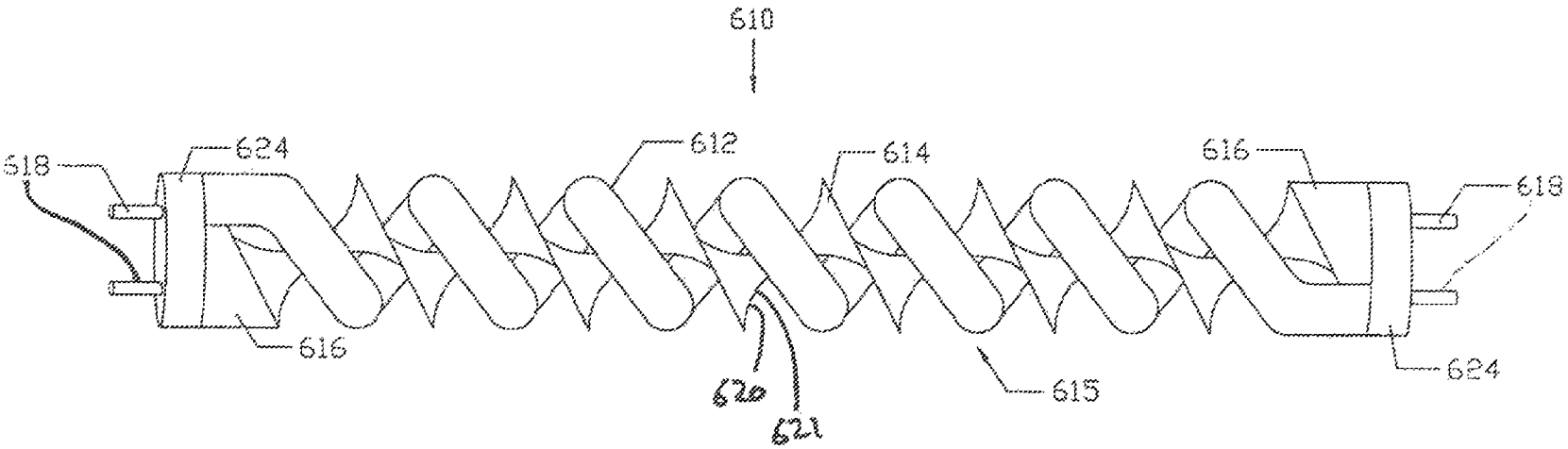
FIG. 18 is a side view of an illumination device with a light source coiled around a primary reflector.
Figure 19:
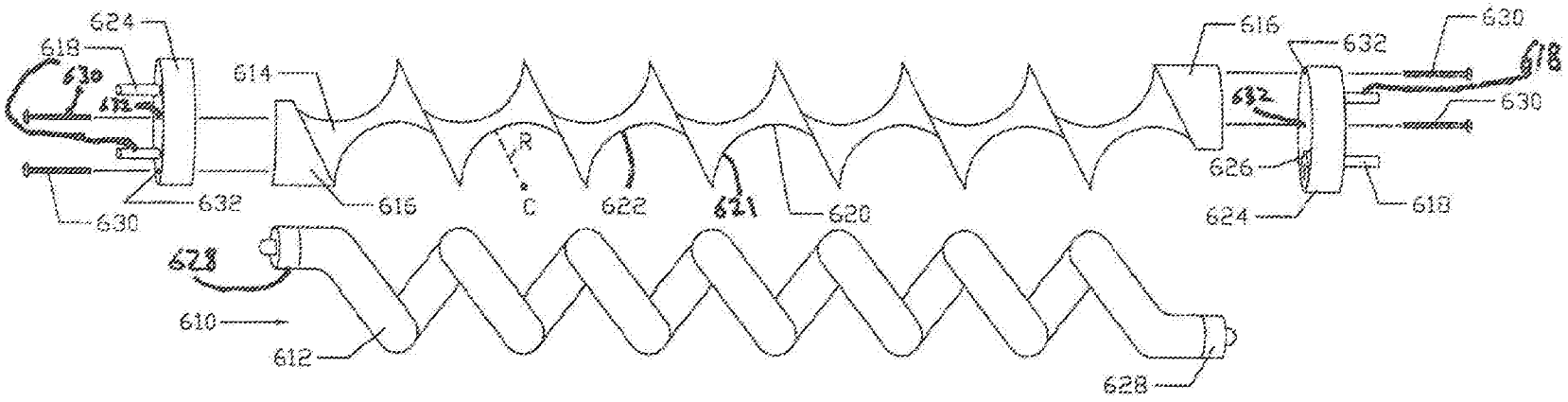
FIG. 19 is an exploded view of the illumination device of FIG. 18.
Figure 20:
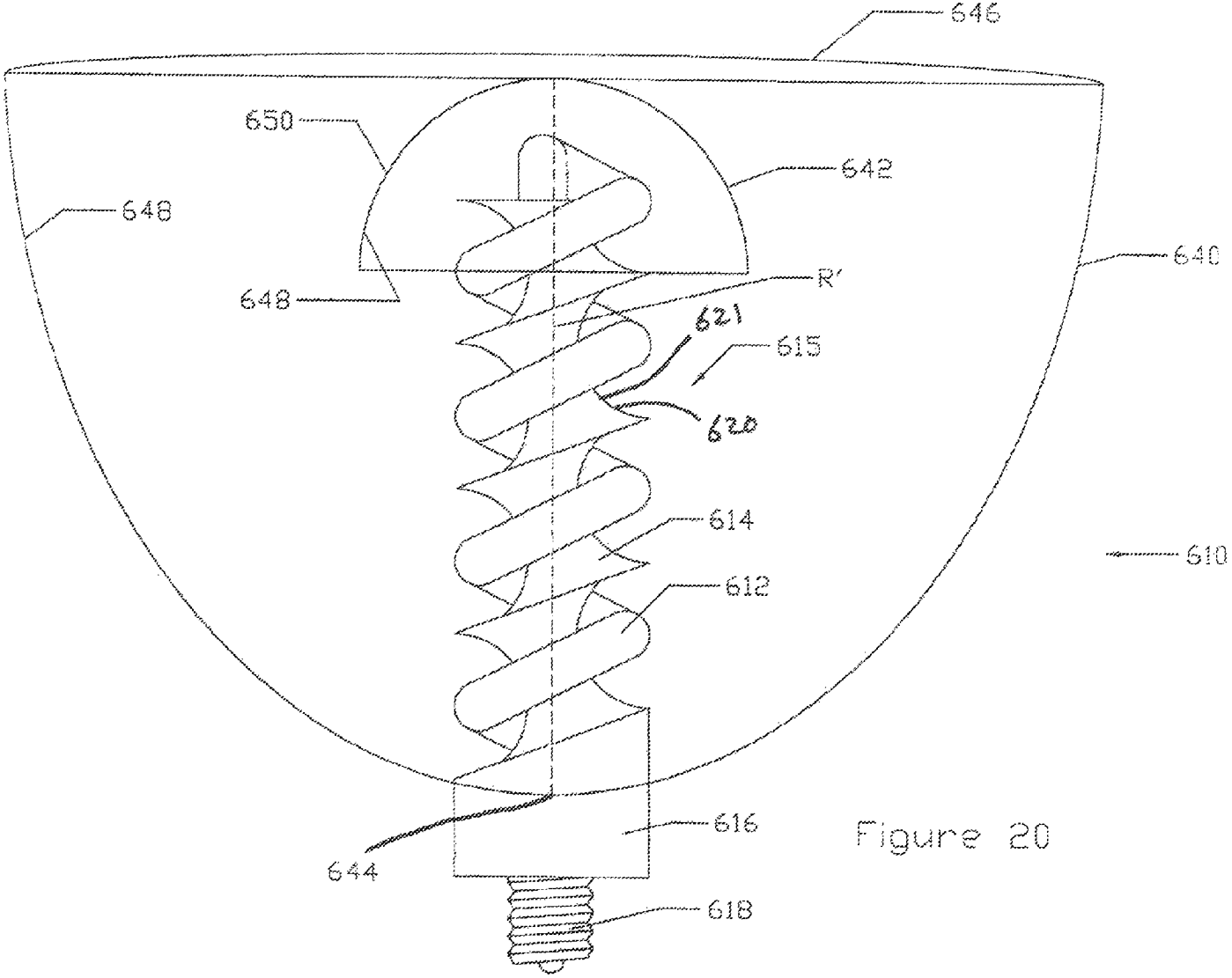
FIG. 20 is a side view of the illumination device of FIG. 18 having a secondary reflector and a tertiary reflector.

As shown in FIGS. 18-20, an illumination device 610 may include a light source 612, such as a fluorescent light, coiling around a primary reflector 614 in a helical fashion. The combination of light source 610 and primary reflector 614 may define a light reflection unit 615. Light reflection unit 615 is typically mounted to one or more bases 616.

Bases 616 may include electrical contacts 618 for electrically coupling with an external power supply. Electrical contacts 618 may take the form of any suitable type of electrical contact known in the art, such as electrically conductive pins as pictured in FIGS. 18 and 19, or a screw base connector as pictured in FIG. 20. Base 616 may house a ballast (not pictured) for regulating current flow through light source 612.

As shown most clearly in FIG. 19, primary reflector 614 may include a helical groove 620 having reflective properties. Helical groove 620 may have an interior curve forming a curved channel 621 with a helical groove apex 622. Helical groove apex 622 is the minimum (or maximum depending on the frame of reference) point along curved channel 621. The interior curve of helical groove 620 may define an effective radius R extending from helical groove apex 622 to an imaginary center C of what would be an approximate circle were curved channel 621 to extend further along its curved path. Light source 612 may be spaced apart radially from primary reflector 614 half the distance of effective radius R, which may correspond to the focal point of light reflected from primary reflector 614.

As shown in FIGS. 18 and 19, bases 616 may be fitted with endcaps 624. In some examples, illumination device 610 may include two or more endcaps 624. In the example shown in FIG. 19, fasteners 630, such as screws, secure endcaps 624 to bases 616 through apertures 632.

Each endcap 624 may include a tombstone 626 in which mating members 628 of light source 612 may insert to electrically couple light source 612 with a power supply. Tombstone 626 may be a "tombstone" style electrical connector as known in the art for facilitating electrical communication between light source 612, such as a fluorescent light, and electrical contacts 618. In the examples shown in FIGS. 18 and 19, electrical contacts 618 comprises electrically conductive pins extending from each endcap 624. The electrically conductive pins are typically configured to mate with a complimentary electrical socket linked to a power supply. Tombstone 626 may be in electrical communication with electrical contacts 618 via a ballast (not pictured), which may regulate the current flow through light source 612, such as a fluorescent light.

In some examples, such as shown in FIG. 20, illumination device 610 may include a secondary reflector 640 and/or a tertiary reflector 642. In some examples, illumination device 610 may include secondary reflector 640 without tertiary reflector 642 or vice versa. Secondary reflector 640 and tertiary reflector 642 each compliment the reflective properties of reflector 614 by redirecting light from light reflection unit 615 towards a target illumination area. However, neither secondary reflector 640 nor tertiary reflector 642 is required and one may be used without the other.

Secondary reflector 640 may generally be in the shape of a paraboloid with a secondary reflector apex 644 opposite an opening 646. Secondary reflector 640 may take additional or alternative shapes such as pyramidal, tubular, or an irregular shape. An interior surface 648 of secondary reflector 640 may have reflective properties. As shown in FIG. 20, secondary reflector may include an effective paraboloid radius R' extending from secondary reflector apex 644 to opening 646.

Secondary reflector apex 644 defines an effective minimum (or maximum depending on the frame of reference) region in the paraboloid shape. Secondary reflector apex 644 may include an apex aperture (not pictured) through which base 616 may extend. Secondary reflector 640 typically attaches to base 616 at secondary reflector apex 644 to yield certain reflective properties from the shape of secondary reflector 640. In the example shown in FIG. 20, the curved shape of secondary reflector 640 may direct light from light reflection unit 615 to a target illumination area.

Tertiary reflector 642 may also have a paraboloid shape with a tertiary interior surface 648 having reflective properties. However, tertiary reflector 642 may take additional or alternative shapes such as pyramidal, tubular, or an irregular shape. Tertiary reflector 642 may also have an exterior surface 650 having reflective properties. In the example shown in FIG. 20, light entering tertiary reflector 642 is reflected downward onto secondary reflector 640. Upon reaching secondary reflector 640, the light may then be reflected towards a target illumination area.

In all embodiments disclosed hereinabove, standard type electrical connections including ballasts, sockets, and standard wiring are employed. Applicant's invention focuses primarily on the reflective aspects of providing additional light to a target illumination area, resulting in more lighting where desired with conservation of energy.

Figure 21:
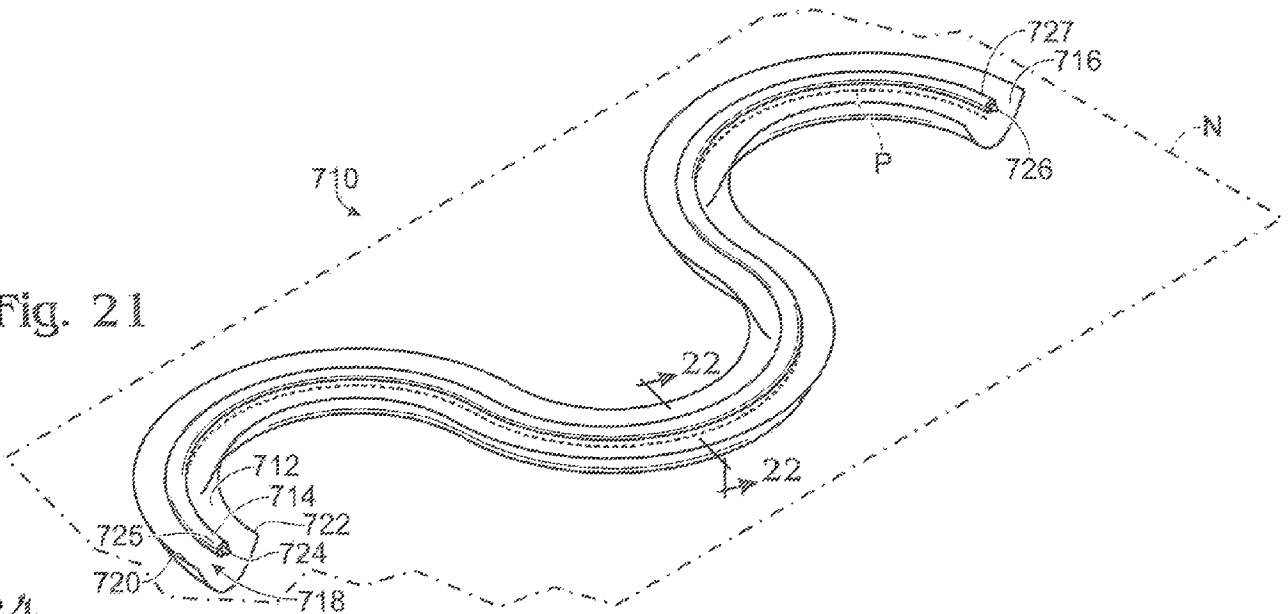
FIG. 21 is a perspective view of an illumination device including a reflector having a curved path.

A further example of an illumination device 710 is shown in FIG. 21. As shown in FIG. 21, illumination device 710 may include a primary reflector 712 and a light source 714 spaced from primary reflector 712. As a point of reference, primary reflector 712 in FIG. 21 may be described as extending longitudinally in a plane P. Additionally or alternatively, primary reflector 712 may extend in three dimensions. Illumination device 710 may be suitable for providing illumination a variety of residential, commercial, and industrial settings.

Figure 22:
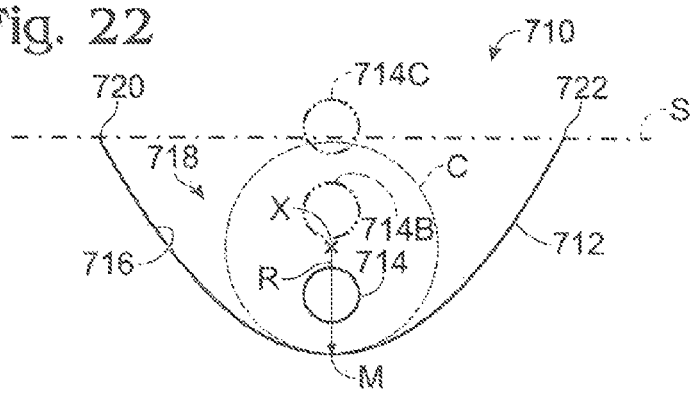
FIG. 22 is a side elevation view of a cross section of the FIG. 21 illumination device taken along line 22-22 in FIG. 21.

As shown in FIGS. 21 and 22, primary reflector 712 may include an exterior surface 716. In some examples, exterior surface 716 reflects light, such as reflecting light towards a first target illumination area. Exterior surface 716 itself may be mirrored or otherwise have reflective properties. Additionally or alternatively, a layer of reflective material or a reflective coating may be supported by exterior surface 716. For example, exterior surface 716 may be a substrate including a metallic coating having light reflective properties.

Exterior surface 716 may define a curved path P as shown in FIG. 21. A wide variety of curved paths are envisioned. For example, a random curved path P extending longitudinally is shown in FIG. 21. An exterior surface 716A shown in FIG. 23 defines a spiral curved path. Helical curved paths are shown generally in FIGS. 1, 2, 7, 8, and 18-20, a circular curved path is shown generally in FIG. 6A, and U-shaped curved paths are shown generally in FIGS. 6B and 9. Other curved paths (not pictured) may include sinusoidal and oblong portions.

Exterior surface 716 may be curved in a plane transverse to the reference plane N. For example, as can be seen in FIGS. 21 and 22, a cross section of exterior surface 716 taken transverse to curved path P may be curved in the shape of a parabola. The curvature of exterior surface 716 may alternatively be described as being latitudinal relative to the longitudinally extending curved path P. Any or all two-dimensional sections of exterior surface 716 along curved path P may be curved in some manner. Alternatively, one or more sections may not be curved.

Exterior surface 716 may partially enclose an interior space 718. Interior space 718 may be the space bounded by exterior surface 716 and an imaginary surface S shown in FIG. 22. Imaginary surface S is shown in FIG. 22 to extend between a first edge 720 of exterior surface 716 and a second edge 722 of exterior surface 716. Imaginary surface S may be a plane, as depicted in FIG. 22, or may be a curved surface complimenting first and second edges 720, 722. For example, imaginary surface S may be curved if the height of the edges 720, 722 varies as curved path P extends longitudinally.

With reference to FIG. 22, the curvature of exterior surface 716 may include a minimum point M and define an effective radius R. The minimum point M may be the point along the curvature of exterior surface 716 in which the curve transitions between ascending or descending or between any other opposed relationship, such as inward and outward. Effective radius R may be the distance between exterior surface 716 and an imaginary center P of an imaginary circle C. Imaginary circle C is a circle that approximately corresponds to or shares a common circumference with a portion of the curvature of exterior surface 716.

Light source 714 of illumination device 710 may be spaced from primary reflector 712 at least partially within interior space 718. As can be seen in FIG. 22, a variety of spacing distances are contemplated. For example, in FIG. 22, light source 714 is shown to be spaced approximately one-half effective radius R from minimum point M of the curved exterior surface 716. The position of light source 714 in FIG. 22 may be referred to as the focal point of exterior surface 716.

As an alternative example, a light source 714B is shown to be spaced greater than the effective radius R from minimum point M of exterior surface 716. Further, a light source 714C is shown to be spaced a distance greater than effective radius R from minimum point M of exterior surface 716. A portion of light source 714C is within interior space 718 and a portion of light source 714C is outside interior space 718.

Spacing light source 714 different distances from exterior surface 716 may be suitable for different applications. For example, different spacing distances may modify the light concentration emanating from illumination device 710. Additionally or alternatively, the spacing may modify the power consumed by illumination device 710 to produce a given amount of illumination. Further, the spacing may modify how heat generated by illumination device 710 is dissipated. In some examples, light source 714 is positioned approximately at the focal point of exterior surface 716 to increase the intensity of light emanating from illumination device 710.

In comparison to light source 714 having a circular cross section as shown in FIG. 22, in some examples, the light source may have oblong cross section (not pictured). In examples where the light source has an oblong cross section, the longer dimension of the oblong cross section may extend along a line extending from minimum point M to center X. Having the longer dimension of the oblong cross section oriented in this manner may fill more of the height of exterior surface 716 with a source of light. As with light source 714 shown in FIG. 22, the light source having an oblong cross section may be spaced a variety of distances from minimum point M.

Light source 714 may include a wide variety of lighting technologies. For example, light source 714 may include fluorescent, incandescent, halogen, xenon, neon, mercury-vapor lights, and gas-discharge lights, as well as light emitting diodes. The light sources shown in FIGS. 21-24 depict fluorescent lights. However, those skilled in the art will understand that fluorescent lights represent only one example of lighting sources that my be used with the presently described illumination devices.

As shown in FIG. 21, light source 714 may extend between a first terminal end 725 and a second terminal end 727 and be curved to compliment curved path P. Light source 714 shown in FIG. 21 may alternatively be described as substantially following curved path P. Thus, light source 714 may be longitudinally curved and extend along exterior surface 716 of primary reflector 716.

For electrically coupling to a power supply (not pictured), light source 714 is shown in FIG. 21 to include a first conductive pin 724 extending from first terminal end 725 and a second conductive pin 726 extending from second terminal end 727. The first and second conductive pins 724 and 725 may couple with a tombstone or other electrical connector as necessary to electrically couple light source 714 to a power supply.

Figure 24:
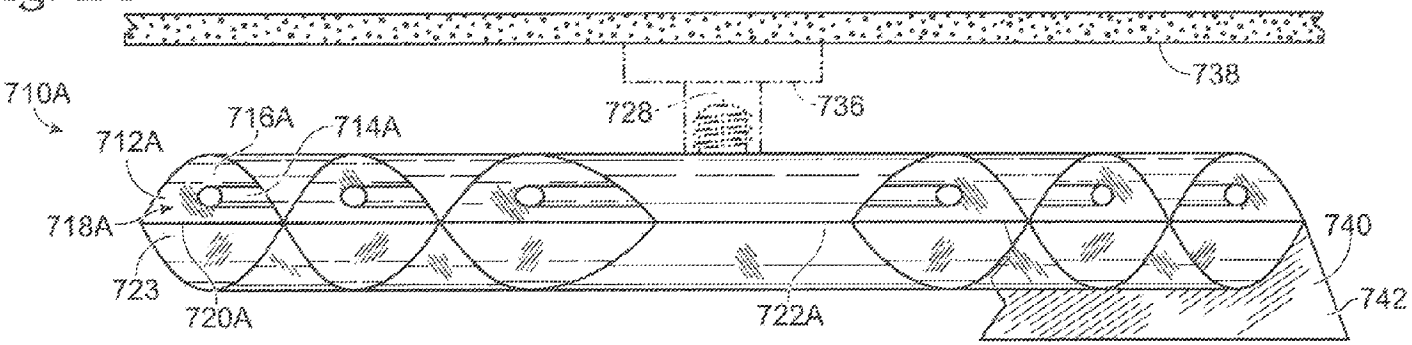
FIG. 24 is a side elevation view of a cross section of the FIG. 23 illumination device example taken along line 24-24 in FIG. 23.
Figure 23:
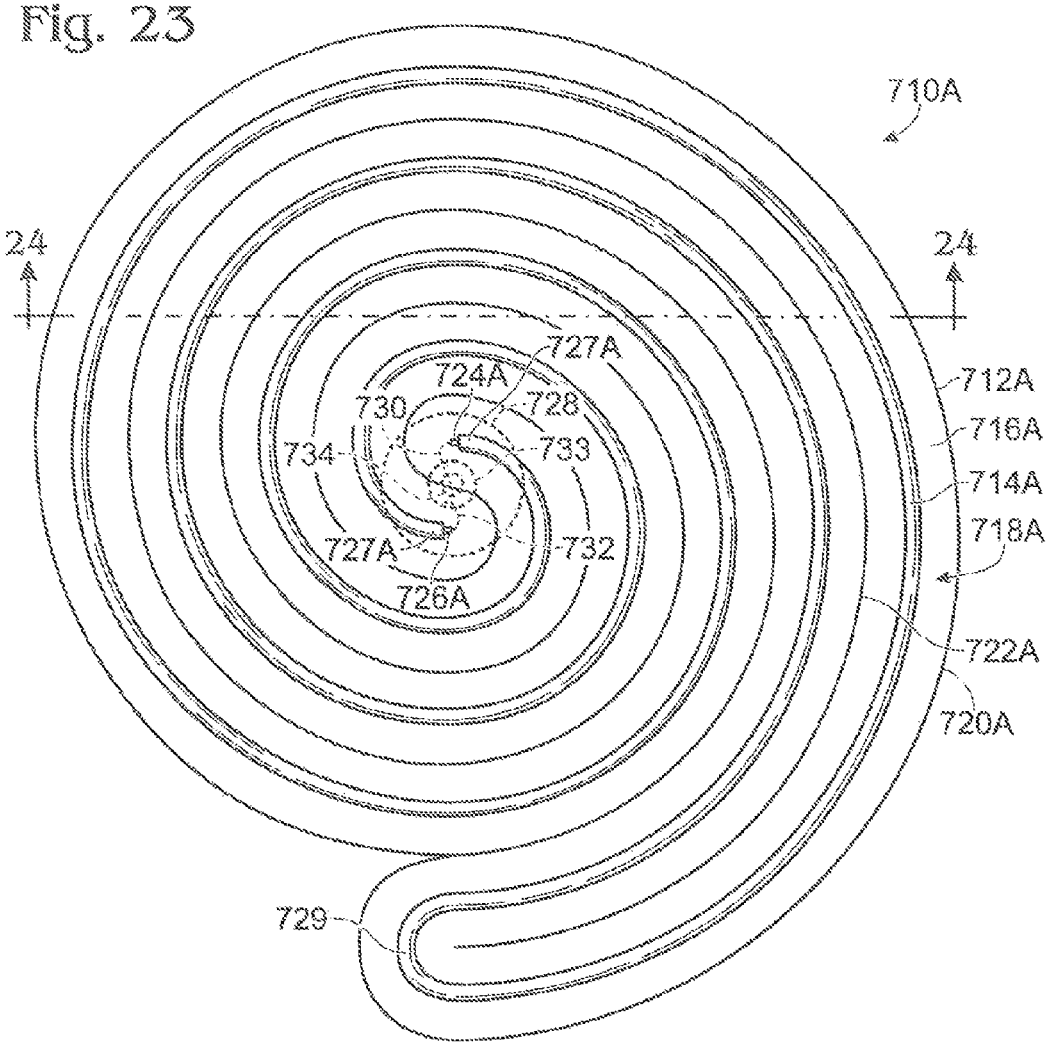
FIG. 23 is a plan view of an underside of an illumination device including a reflector having a spiral curved path.

An alternative illumination device 710A is shown in FIGS. 23 and 24. As shown in FIGS. 23 and 24, illumination device 710A may include a primary reflector 712A at least partially surrounding a light source 714A. Light source 714A may extend between a first terminal end 725A and a second terminal end 727A. Primary reflector 712A may include an exterior surface 716A having reflective properties.

As shown in FIG. 23, exterior surface 716A may extend in a curved path, such as a spiral curved path. Additionally or alternatively, exterior surface 716A may be curved to at least partially surround light source 714A. The curvature of exterior surface 716A may be concave facing light source 714A and may partially enclose an interior space 718A. The partially enclosed interior space 718A may be defined as the space surrounded by the concave exterior surface 716A and within an imaginary surface extending between a first edge 720A of exterior surface 716A and a second edge 722A of exterior surface 716A.

With reference to FIG. 24, illumination device 710A may include a lens 723 extending between first edge 720A and second edge 722A. Lens 723 may be formed from glass, plastic, or other polymeric material. Permanent, semi-permanent, or selective attachment of lens 723 to primary reflector 712A is contemplated, such as with adhesive, magnetic, snap on, or screw in, attachment means. Lens 723 may be curved, as shown in FIG. 24, or may be flat, angular, or irregular.

Lens 723 may be transparent, translucent, colored, or selectively opaque. Light may be refracted by lens 723 or may pass substantially unaffected through lens 723. Lens 723 may include patterns, designs, or etchings configured to direct light in certain directions or to concentrate light towards certain areas, such as a target illumination area. In some examples, lens 723 may redirect or reflect ambient light towards a target illumination area.

Light source 714A may be spaced a variety of distances from exterior surface 716A. For example, light source 714A may be spaced at the focal point of exterior surface 716A, or may be spaced closer to or farther from exterior surface 716A than the focal point. In some examples, such as shown in FIG. 24, light source 714A is positioned wholly within the interior space 718A, while in other examples, light source 714A is positioned partially within interior space 718A. Further, light source 718A may be positioned wholly outside of interior space 718A in some applications.

As shown in FIG. 23, light source 714A may be bent into a bent configuration that brings first terminal end 725A and second terminal end 727A substantially adjacent to one another. In the bent configuration, light source 714A may include one or more bends 729. Bend 729 may be formed at a midpoint of light source 714A or at any point between first and second terminal ends 725A, 727A. In some examples, exterior surface 716A includes complimentarily bends to correspond with light source 714A in the bent configuration.

As can be seen in FIG. 23, the spiral curved path may include a center portion. First and second terminal ends 725A, 727A may be substantially adjacent to each other at or adjacent to the central portion. Having first and second terminal ends 725A, 727A substantially adjacent at the central portion may obviate the need for tombstones or other electrical connectors. In the bent configuration shown in FIGS. 23 and 24, a common, centrally disposed screw base connector 726 is used to connect both first and second terminal ends 725A, 727A to a power supply (not pictured).

A variety of connectors and connection means may be used to electrically connect light source 714A to a power supply. As shown in FIGS. 23 and 24, light source 714A may include first and second conductive pins 724A, 726A extending from first and second terminal ends 725 and 727, respectively. As mentioned above, an example of a screw base connector 728 is shown in FIGS. 23 and 24. In the example shown in FIG. 24, first and second wires 730, 732 electrically couple first and second conductive pins 724A, 726A with screw base connector 728, respectively.

Screw base connector 728 may include a first connection portion 733 providing a current path for an electrical circuit. Further, screw base connector 728 may include a second connection portion 734 providing a current path for an electrical circuit. First connection portion 733 may provide a current path from a power supply to illumination device 710A and second connection portion 734 may provide a current path to electrical ground or other relatively lower electrical potential destination, or vice versa. As shown in FIG. 23, a first wire 730 may electrically couple first conductive pin 724 with first connection portion 733. Further, a second wire 732 may electrically couple second conductive pin 726 with second connection portion 734.

As shown in FIG. 24, screw base 738 may couple with a fixture 736 that mounts to a mountable surface 738, such as a ceiling, wall, bookcase, or desk. Additionally or alternatively, illumination device 710A may be supported from the ground by a base, such as in a free-standing lamp configuration. Illumination device may also by supported in handheld devices, such as flashlight, lantern, or torch bodies.

Illumination device 710A may include any and all components necessary for proper functioning of light source 714A. For example, ballasts, internal connection components, such as wires and other circuitry, and suitable insulating materials may be included as necessary. Further, in some examples, illumination device 710A may include a portable power source, such as a battery, a generator, or a fuel cell, to power light source 714A.

Additionally or alternatively to primary reflector 712A, illumination device 710A may include a secondary reflector 740 having a reflective surface 742. As shown in FIG. 24, secondary reflector 740 may be supported by primary reflector 712A and extend beyond primary reflector 712A. By extending beyond primary reflector 712A, secondary reflector 740 may reflect light emanating from light source 714A that would not be reflected by primary reflector 712A. Additionally or alternatively, secondary reflector 740 may reflect again light that was previously reflected by primary reflector 712A.

In some examples, secondary reflector 740 is configured to reflect light towards a second target illumination area. The second target illumination area may be the same or different than the first target illumination area towards which primary reflector 712A may reflect light. The size, the angle and orientation, and the shape of secondary reflector 740 may influence how it reflects light. In some examples, secondary reflector 740 is frustoconical. A frustoconical secondary reflector 740 may enclose an inner volume and orient interior surface 742 at a non-90 degree angle to light emanating from light source 714A and reflecting from primary reflector 712A.

Figure 25B:
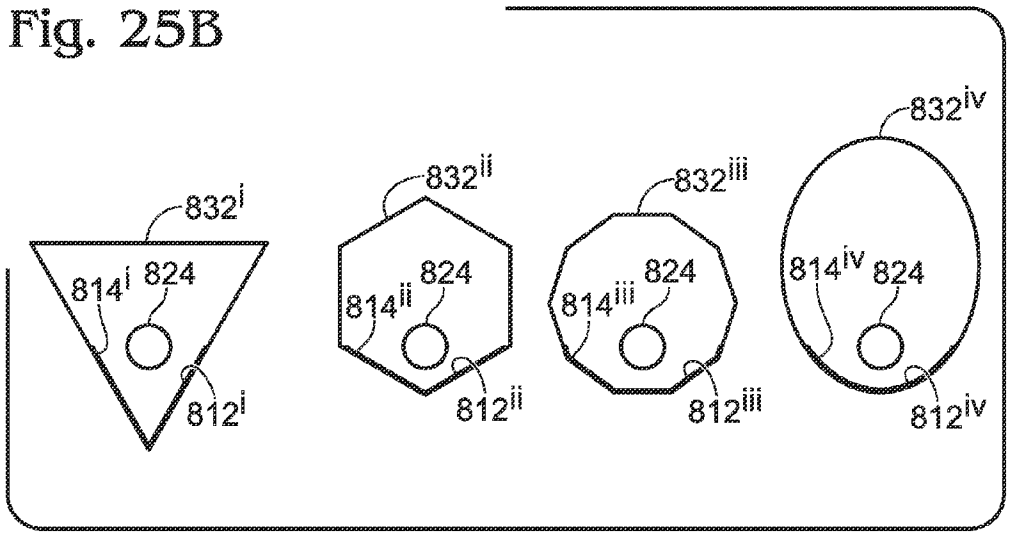
FIG. 25B depicts cross sections of alternative examples of lighting apparatuses.
Figure 25A:
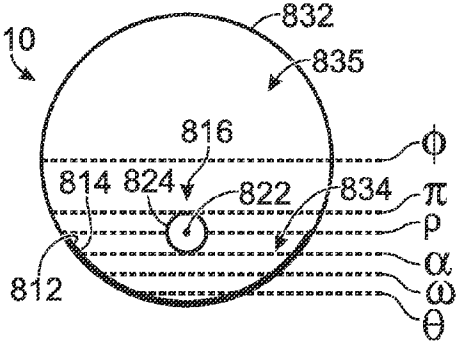
FIG. 25A is a side elevation view of a cross section of the FIG. 26 illumination device taken along line 25A-25A in FIG. 26.
Figure 26:
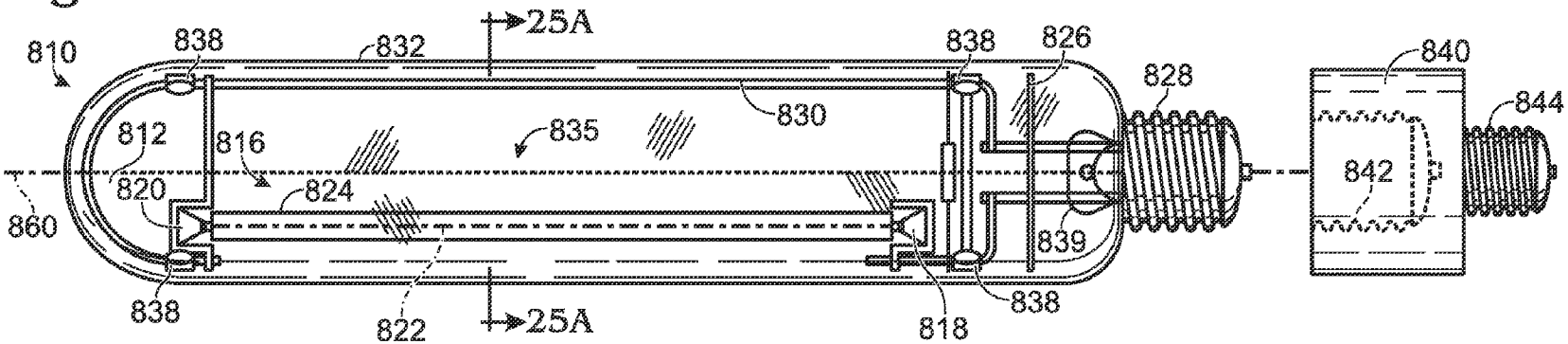
FIG. 26 is a side elevation view of another example of a lighting apparatus.

A further example of a lighting apparatus 810 that embodies certain features of this disclosure is shown in FIGS. 25A and 26. FIGS. 25A and 26 are non-limiting and merely illustrative examples, and lighting apparatuses according to the present disclosure may have shapes and physical arrangements different to that shown in FIGS. 25A and 26. In the example shown in FIGS. 25A and 26, lighting apparatus 810 includes a reflector 812 and a light sources 816 at least partially within the interior space 834 defined by the reflector 812.

Reflector 812 functions to reflect light from a light source 816 more efficiently toward a target illumination area. As shown in FIGS. 25A and 26, reflector 812 includes a reflective exterior surface 814 facing light source 816 to reflect light from light source 816 toward a target illumination area.

In some embodiments, such as the one illustrated in FIG. 26, reflector 812 extends along a longitudinal axis 860 defined by lighting apparatus 810. In the example shown in FIG. 26, longitudinal axis 860 is transverse to the direction in which light travels to the target illumination area. In other embodiments, such as reflector 1012 shown in FIG. 28 having a reflective exterior surface 1014 defining an elliptical paraboloid, the reflector and/or the reflective exterior surface may revolve around an axis, such as axis 1060 in FIG. 28, extending toward the target illumination area. As shown in FIG. 26, exterior surface 814 of reflector 812 defines a series of focal points 822 as it extends along a longitudinal axis 860.

Light source 816 provides a means for generating light in lighting apparatuses 810. In the embodiment shown in FIG. 26, light source 816 comprises a first electrode 818, a second electrode 820, and an arc tubes 824. However, the reader should understand that light sources that do not comprise these same exact elements are equally within this disclosure.

In the embodiment shown in FIG. 26, arc tube 824 contains a gas between first electrode 818 and second electrode 820. In the present example, arc tube 824 is hermetically sealed. In various embodiments, the gas contained in arc tube 824 comprises a metal halide, mercury, sodium, or any other gas that may generate light when ionized by an electrical current. Light source 816 shown in FIG. 26 (as well as in FIGS. 27 and 28) defines a high pressure discharge lamp positioned substantially at focal point 822 of reflective exterior surface 814. In some embodiments, the light source defines a low pressure discharge lamp.

In some embodiments, reflective exterior surface 814 is composed of reflective materials, such as reflective metals including aluminum or conventional mirror surfaces. In the example shown in FIG. 26 (as well as in FIGS. 27 and 28), reflective exterior surface is formed by depositing aluminum vapor onto an inner surface of envelope 832. In other examples, the lighting apparatus includes reflector members positioned near and/or around light source 816. In such examples, the reflector members have exterior surfaces made out of reflective metals or mirrors to reflect light. As another non-exclusive example, the reflector and its corresponding exterior surface may comprise a reflective material or coating applied to an envelope 832 containing a light source 816.

The reflective exterior surface may define several different shapes with unique focal point geometries. For example, as shown in FIGS. 25A and 25B, a cross section of the reflective exterior surface transverse to longitudinal axis 860 may define a portion of a regular polygon or a parabola. FIG. 25B illustrates a series of non-exclusive examples of reflective exterior cross sections, including 1) reflector 812*i* mounted on envelope 832*i* and having surface 814*i*, which defines a portion of a triangle; 2) reflector 812*ii* mounted on envelope 832*ii* and having surface 814*ii*, which defines a portion of a hexagon; 3) reflector 812*iii* mounted on envelope 832*iii* and having surface 814¬ *iii*, which defines a portion of a decagon; and 4) reflector 812*iv* mounted on envelope 832*iv* and having surface 814*iv*, which defines a portion of an oval, which could also be described as a parabola. FIG. 25B is illustrative, and shapes of reflective exterior surfaces according to this disclosure are not to be limited to the examples illustrated in the figures, but rather include any other shape that may be useful in efficiently illuminating a target illumination area.

With reference to FIG. 25A the reader can see that reflective exterior surface 814 may partially enclose different amounts of interior space 834 depending on the particular arc length defined by the exterior surface. In FIG. 25A, a variety of different exterior surface arc length examples are indicated with dashed lines identified by lower case Greek letters denoting the different angles the arcs are subtending. For example, in FIG. 25A, the arc indicated by the dashed line identified by $\Phi$ would comprise the portion of the ellipse below the dashed line denoted as $\Phi$. In FIG. 25A, the reflective exterior surface arc examples subtend angles of approximately 40° ($\theta$), 64° ($\omega$), 94° ($\alpha$), 110° ($\rho$), 128° ($\pi$), and 172° ($\Phi$), but any angle between 0° and 360° is equally within this disclosure.

FIG. 25A illustrates a circular embodiment, but embodiments with exterior surfaces having polygonal cross sections will also partially enclose different amounts of interior space depending on the dimensions of the polygon defined by the reflective surface.

In the example shown in FIGS. 25A and 26, light source 816 is placed substantially at a focal point defined by a reflective exterior surface 814. The focal point of a given reflector will depend on its geometry. There are mathematical expressions for the focal point of a curved reflector. Reflectors having a polygonal geometry will have more complex mathematical expressions for the focal point or can be described as having an "effective focal point" that approximates the focal point of a curved reflector. The inventor has discovered that placing the light source at the focal point or effective focal point provides more efficient illumination to a target illumination area.

As mentioned above, the focal point of a given reflector will depend on its geometry. For example, prior discussions have defined the focal point of concave reflectors with generally circular cross sections as half the radius of the circle divided by two. For concave reflectors with a cross section in the shape of a parabola, the focal point can be defined as the product of one-half the maximum interior width of the parabola squared divided by four times the height of the parabola. Any method of calculating the focal point of a given geometry, including any focal point approximations, may be used to determine the focal point of a given reflector.

In embodiments in which the reflective exterior surface 814 extends longitudinally, including those with parabolic and polygonal cross sections, the reflective exterior surface may define a series of focal points. As a non-exclusive example, a series of focal points 822 are shown in FIG. 26. In FIG. 26, focal points 822 include all of the points at the focus of a parabolic cross section spanning the length of the reflective exterior surface 814. However, such a series of focal points may comprise any collection of points within the reflective exterior surface.

As can be seen in FIG. 26, lighting apparatus 810 includes a base electrode 828. Base electrode 828 electrically couples light source 816 with a complimentary electrical socket to provide energy to lighting apparatus 810 from the electrical socket. Base electrode 828 is connected to at least one of first or second electrode 818 and 820 of lighting apparatus 810.

Lighting apparatus 810 shown FIG. 26 includes a conductive steel frame 830 supporting light source 816. Conductive steel frame 830 electrically connects first and second electrodes 818 and 820 with base electrode 828. With brief reference to FIG. 28, the reader can see that a lighting apparatus 1010 includes a similar conductive steel frame 1030. Conductive steel frame 1030 supports a first electrode 1018 and a second electrode 1020 as well as electrically connects these electrodes to a base electrode 1028.

In the particular example shown in FIG. 26, lighting apparatus 810 includes a second reflector 826 disposed between light source 816 and base electrode 828. Second reflector 826 is positioned to reflect away from base electrode 828 a substantial portion of the light that would otherwise be directed toward base electrode 828. Second reflector 826 may be made of any reflective material, such as reflective metals or mirrors. In some examples, the second reflector is not positioned to reflect light away from base electrodes 828, but instead is positioned to reflect light in a beneficial direction to more efficiently direct light towards a target illumination area.

As shown in FIG. 26, some embodiments of lighting apparatuses according to the present disclosure may additionally comprise an adapter. In FIG. 26, adapter 840 includes a recess electrode 842 complimentarily configured with base electrode 828 and an adapter electrode 844 electrically connected to recess electrode 842. Adapter electrode 844 is complimentarily configured with a desired electrical socket.

In some embodiments, the adapter electrode is designed to complement electrical sockets that are physically incompatible with base electrode 828. However, this is not required, and embodiments that implement adapters in which base electrode 828 and the adapter electrode physically complement the same electrical socket are equally within this disclosure.

In some examples, the adapter includes compatibility means for using the lighting apparatus with electrical sockets that are otherwise electrically incompatible with such lighting apparatuses. The compatibility means may comprise electrical circuitry, including transformers, that covert electrically incompatible power from the electrical socket to electric power that is compatible with a particular lighting apparatus. Such conversion circuitry, however, is not required, and in some embodiments the adapter outputs power to the base electrode from the electrical socket unchanged.

In the example shown in FIG. 26, lighting apparatus 810 includes an envelope 832 attached to base electrode 828 and enclosing light source 816, the reflector 812, or both. In FIG. 26, envelope 832 is substantially clear, however different levels of opacity are equally within the present disclosure. In some embodiments, the envelope may have a tint that changes the color of the light emitted from the lighting apparatus.

In lighting apparatus 810, reflector 812 comprises a metal coating deposited onto a portion of envelope 832. Additionally or alternatively, there may be one or more reflectors included as a separate body from envelope 832, that is, not a coating applied to envelope 832.

FIG. 26 shows an illustrative, non-limiting example of a lighting apparatus 810 embodying elements of the present disclosure. In FIG. 26, lighting apparatus 810 includes envelope 832 connected to base electrode 828. Envelope 832 encloses an interior space 835 substantially evacuated of air to form a vacuum. Envelope 832 is formed from weather resistant glass, but plastics and other suitable materials may be readily used.

In the example shown in FIG. 26, approximately one-half of envelope 832 is exposed to vaporized aluminum, which deposits on envelope to form a coating representing reflector 812 with a reflective exterior surface 814. In other examples, more or less than one-half of envelope 832 is coated with a reflective material. A cross section of reflector 812 is shown in FIG. 25A, with alternative reflector shape cross sections depicted in FIG. 25B.

As shown in FIG. 26, lighting apparatus 810 includes a steel frame 830 and dome mount supports 838 that cooperate to maintain the position of light source 816 substantially at focal point 822 of reflector 812. In the example shown in FIG. 26, steel frame 830 is electrically conductive, and electrically connects base electrode 828 to both first and second electrodes 818 and 820.

In the embodiment shown in FIG. 26, light source 816 comprises a high pressure sodium lamp with an arc tube 824, which is hermetically sealed. As shown in FIG. 26, lighting apparatus 810 includes an additional reflector 826 reflecting light away from base electrode 828 and a residue gas getter 839 attached to base electrode 828.

Figure 27:
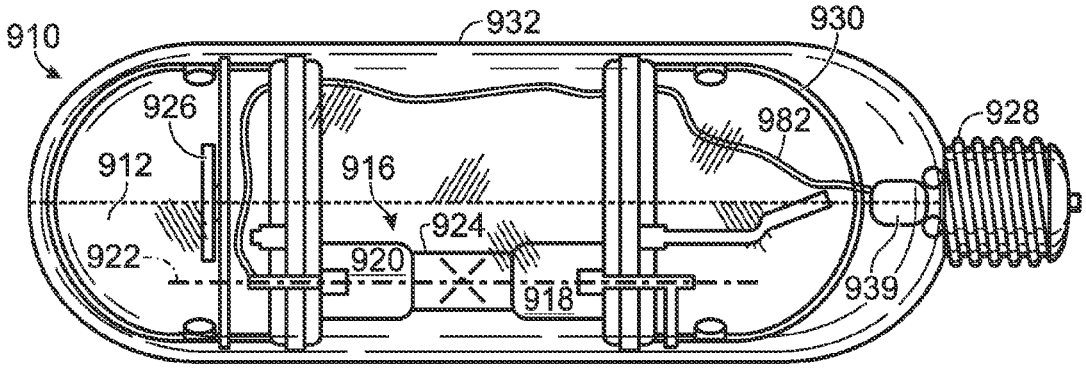
FIG. 27 is a side elevation view of a further example of a lighting apparatus.

Turning attention to FIG. 27, a lighting apparatus 910 will be described. As can be seen in FIG. 27, lighting apparatus 910 includes a reflector 912, a light source 916, a base electrode 928, and an envelope 932. Features of lighting apparatus 910 that are substantially similar to the features of lighting apparatus 810 will not be redundantly explained. Rather, the use of related reference numbers (e.g., 812 vs. 912) should cue the reader that the features are similar and that the discussion above pertains to the given similar feature being referenced.

As can be seen in FIG. 27, light source 916 includes a first electrode 918, a second electrode 920, and an arc tube 924. Arc tube 924 contains a gas between first electrode 918 and second electrode 920. Specifically, in this present example arc tube 924 contains metal halide. From the foregoing, the reader will appreciate that light source 916 defines a high-pressure discharge lamp configured to generate light by discharging electricity between first electrode 918 and second electrode 920 through the gas within arc tube 924.

As can be seen in FIG. 27, reflector 912 includes a reflective exterior surface partially enclosing an interior space and defining a focal point 922 within interior space 934. As can further be seen in FIG. 27, arc tube 924 is disposed at least partially within the interior space and substantially at focal point 922. Lighting apparatus 910 also includes a secondary reflector 926 mounted adjacent light source 916 and distal a base electrode 928.

In the example shown in FIG. 27, a first electrode 918 is connected to base electrode 928 by a conductive steel frame 930. A second electrode 920 is electrically connected to base electrode 928 by a return lead 982. Return lead 982 may comprise a metallic wire or other conductive body.

As shown in FIG. 27, lighting apparatus 910 includes a gas getter 939. The inventor contemplates use of any suitable conventional gas getter.

Figure 28:
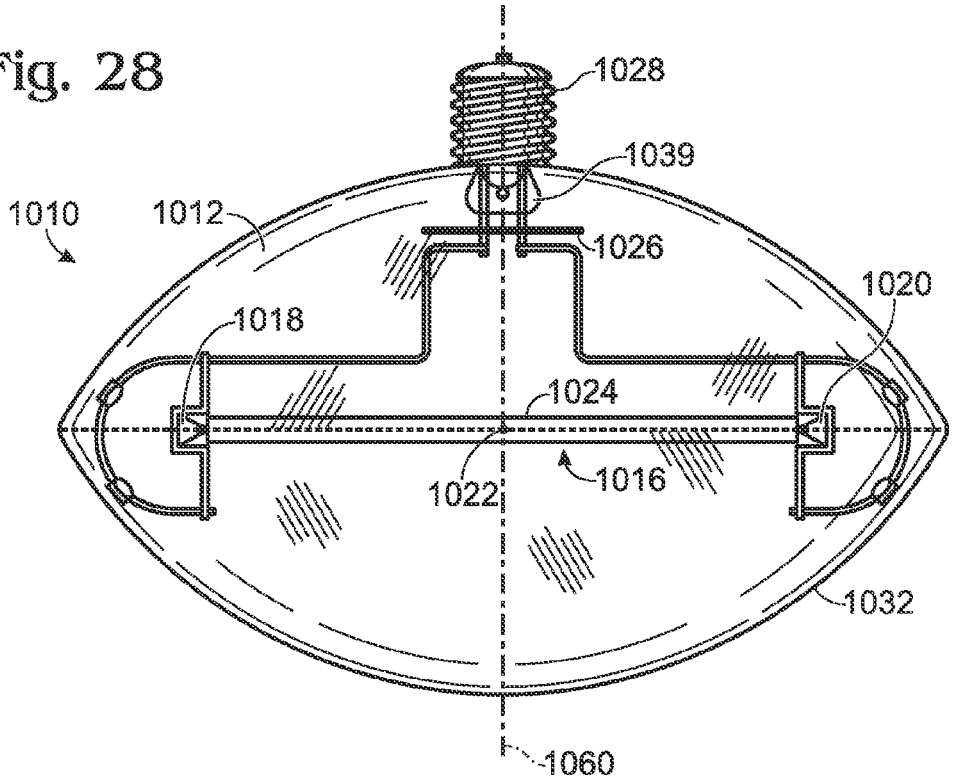
FIG. 28 is a side elevation view of yet another example of a lighting apparatus.

Turning attention to FIG. 28, a lighting apparatus 1010 will be described. As can be seen in FIG. 28, lighting apparatus 1010 includes a reflector 1012, a light source 1016, a base electrode 1028, and an envelope 1032.

As can be seen in FIG. 28, light source 1016 includes a first electrode 1018, a second electrode 1020, and an arc tube 1024. Arc tube 1024 contains a gas between first electrode 1018 and second electrode 1020. Specifically, in this present example arc tube 1024 contains sodium. From the foregoing, the reader will appreciate that light source 1016 defines a high-pressure discharge lamp configured to generate light by discharging electricity between first electrode 1018 and second electrode 1020 through the gas within arc tube 1024.

As shown in FIG. 28, envelope 1032 is made of a weather resistant glass and has a shape comprising two elliptical paraboloids of substantially equal size joined at their open ends. In the example shown in FIG. 28, the paraboloid half of envelope 1032 connected to base electrode 1028 is coated with aluminum via a vapor deposition process to form reflector 1012 with a reflective exterior surface. The lower paraboloid half of envelope 1032 is clear for light to pass through.

As can be seen in FIG. 28, reflective exterior surface 1014 partially encloses an interior space and defines a focal point 1022 within the interior space of reflector 1014. As can further be seen in FIG. 28, arc tube 1024 is disposed at least partially within the interior space and substantially at focal point 1022. Lighting apparatus 1010 also includes a secondary reflector 1026 mounted proximate base electrode 1028 to reflect light away from base electrode 1028 and towards a target illumination area.

As shown in FIG. 28, lighting apparatus 1010 includes a gas getter 1039. The inventor contemplates use of any suitable conventional gas getter.

The principles discussed above can be used to provide a modular light-and-reflector combination, or lighting module 1100, that can be used in retrofitting various types of lamps and light sources. FIGS. 29-34 show various aspects of a lighting module 1100 according to the present disclosure.

As noted above, a typically efficient reflector may include a substantially paraboloid reflective surface, and the attributes disclosed above for the reflector and lamp combination apply as well to the following embodiments. The paraboloid reflector will usually have a focal point at a location defined by $(\text{radius})^2/4*(\text{depth})$, at which the lamp within the reflector should be placed for optimum light focusing. In one sense, a paraboloid reflector can be considered an ellipse having one focal point at infinity.

Figure 29:
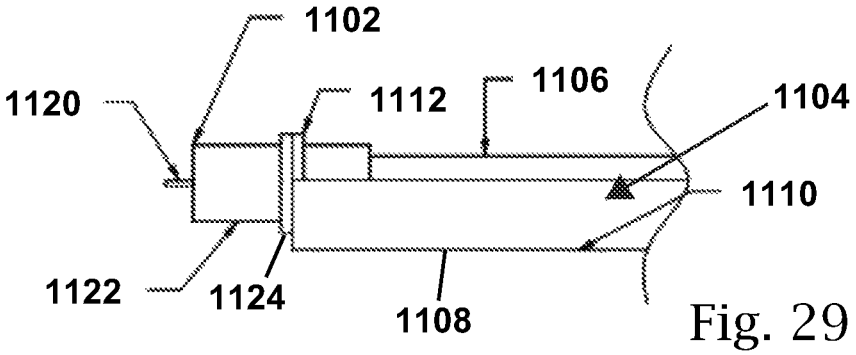
FIG. 29 is an embodiment of a lighting module according to the present disclosure.
Figure 30:
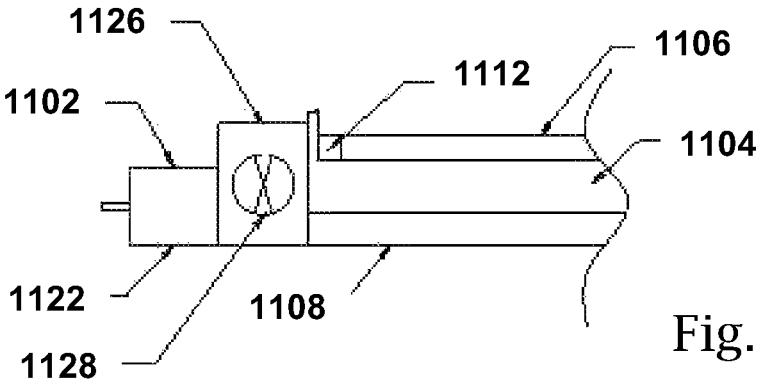
FIG. 30 is another embodiment of a lighting module according to the present disclosure.

As can be seen in FIGS. 29-30, a typical embodiment of a lighting module 1100 will include an adapter 1102 and reflector 1104. The module is configured to accept one or more types of lamps 1106, which will usually be coupled to the adapter 1102 and have their light reflected by reflector 1104. As with the above embodiments, the adapter 1102 and reflector 1104 will typically be configured such that the lamp 1106 resides at the focal point of the substantially paraboloid reflector.

As can be seen from the Figures, the reflector 1104 may include a reflector frame 1108 that may be configured with a reflective surface 1110. As noted above, the reflector frame may be constructed of any appropriate material, including (for example) plastic, metal, etc. The reflector may be semi-cylindrical, or paraboloid, or any desired shape to accommodate what will typically be a paraboloid reflector. The reflective surface 1110 can also be formed in any appropriate manner that provides for reflection of the lamp's light under the conditions of the lamp's use. In some embodiments, such as when the lighting module 1100 is used in a light fixture that has its own reflector, the reflector may not be provided, or it may be provided without a reflective surface 1110. Also, in some embodiments, the reflective surface 1110 may be integral with the reflector frame 1108, while in other embodiments the reflective surface 1110 may be slightly or substantially spaced apart from the reflector frame 1108.

Figure 35:
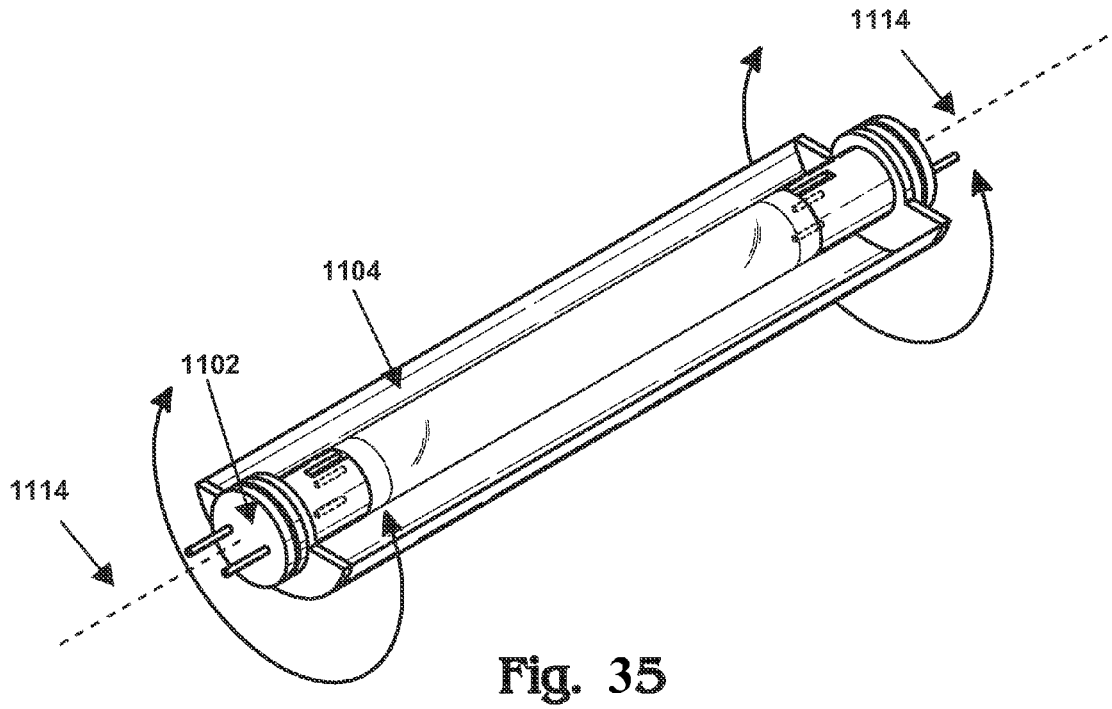
FIG. 35 is a perspective view of the lighting module shown in FIG. 29.
Figure 36:
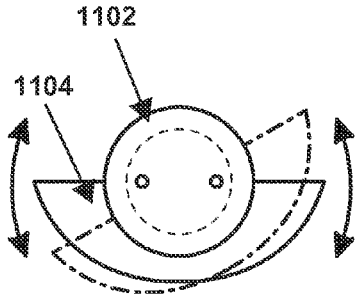
FIG. 36 is a side elevation view of the lighting module shown in FIG. 29.

As can be seen from the Figures, the adapter 1102 in most embodiments has a circular cross-section. So that it may be rotatably coupled to such an adapter, a reflector 1104 in the same lighting module may be provided with a slip ring 1112. The slip ring will typically be provided with a substantially circular cross-section just slightly larger than the cross-section of the adapter to which it will be attached. In this way, the reflector may be rotated around the adapter to any desired configuration; this rotation may occur around a rotational axis 1114 substantially aligned with an included lamp 1106. In cases where the lighting module includes a lamp 1106, such rotation of the reflector 1104 may serve to direct reflected light in a desired direction. In other embodiments the slip ring 1112 may be coupled, and allow the reflector to rotate around, the lamp or other structure besides the adapter. FIGS. 35 and 36, for example, illustrate reflector 1104 rotatably coupled adaptor 1102 to be rotated around the lamp, around longitudinal axis 1114 shown in FIG. 32A.

Figure 31:
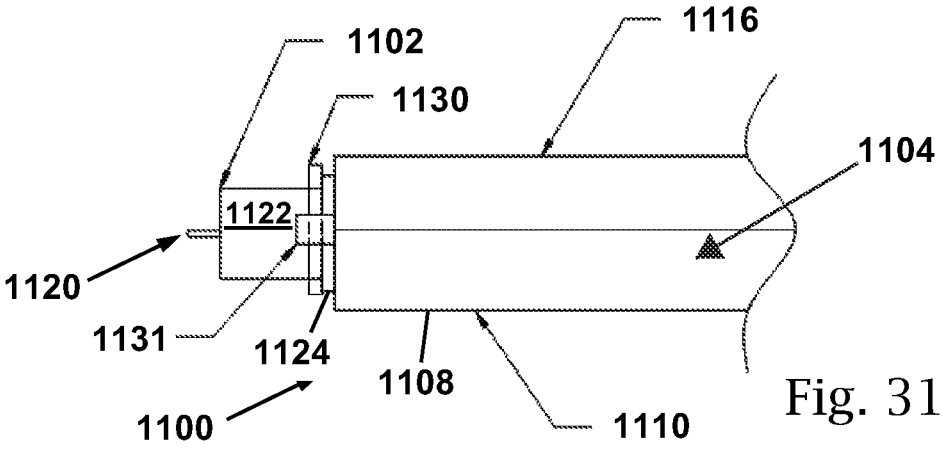
FIG. 31 is another embodiment of a lighting module according to the present disclosure.

In some embodiments, such as the one shown in FIG. 31, the reflector frame 1108 may completely surround an included lamp 1106, such that the assembled parts form a cylindrical, rather than semicylindrical, structure. In these embodiments, the reflector frame 1108 may be coupled, typically reversibly, to an envelope element, or lens, 1116. Such a configuration may serve to more completely protect an included lamp 1106 when, for example, the lighting module 1100 (and a light fixture to which it is coupled) are placed in an environment that may be potentially damaging to the lamp.

Looking especially to FIGS. 33A-C, there are shown some features of embodiments of adapter 1102. The adapter may function to allow some lamps 1106 to be coupled to light fixtures for which they were not designed. For example, because the paraboloid reflector described here may provide highly efficient light reflection, it may be possible to replace a higher wattage lamp with a lower wattage lamp. Or a smaller lamp in place of a larger one. For example, the adapter could be used to couple a T5 lamp bulb to a standard-sized T12 recessed fluorescent light fixture.

To couple a lamp of one size to a light fixture made for another, the adapter may include a first set of female mini-pin electrodes 1118 and a second set of male medium pin electrodes 1120. Thus, a smaller lamp 1106 having male mini-pin electrodes can couple to the female mini-pin electrodes of the adapter, and the male medium pin electrodes of the adapter can, in turn, couple to the electrodes of the light fixture. In this way, the adapter may facilitate, and be in, electrical communication with the lamp through their electrical contacts, or electrodes. Note that the use of the adapter will thus allow nominally incompatible electrodes to be in electrical communication. Although shown as having pairs of pins at each end, the adapter may utilize any appropriate combinations of pins to accommodate various configurations of lamps and light fixtures. For example, the adapter may use mini bi-pins, medium bi-pins, 4-pin connectors, recessed DC, or single-pin connectors, as the case may be.

Note that because a lower-wattage lamp 1106 may be placed into a higher-wattage fixture with the adapter 1102, some provision may need to be made to modify the characteristics of the power flowing to the lamp. In the illustrated embodiments of an adapter 1102, the adapter may include an integral stepdown transformer 1122. This transformer may alter the characteristics of the power supplied to the lamp 1106 by changing the voltage (for example, lowering the voltage) and/or the current (for example, increasing the current) so that they are appropriate for the lamp to which the adapter 1102 is connected. Typically, the adapter will utilize the ballast of the light fixture to provide regulated current, with the adapter simply changing the current to a different level. In these simplest embodiments, the adapter 1102 may simply lower the voltage to a single set level.

The adapter may also include a lock ring 1124, useful in coupling the adapter to, for example, a reflector frame 1108, in a manner described below.

In some embodiments, the adapter 1102 may be coupled to a dimmer control 1126 with or without an included dimmer knob 1128. In this case, the voltage to the lamp may be reduced so that its power consumption can be minimized while still providing enough light for whatever activity may be occurring in the lit location. The dimmer knob 1128 may be configured to allow fine control over the activity of the dimmer control, allowing small adjustments to be made to the electrical flow to the lamp. In other embodiments, the dimmer knob 1128 may have discrete settings allowing only rough control over the electrical flow to the lamp.

Although described as typically being integral components of the adapter, in some embodiments the transformer and/or dimmer control may be separate elements to which the adapter is coupled at the time of its use.

Figure 34:
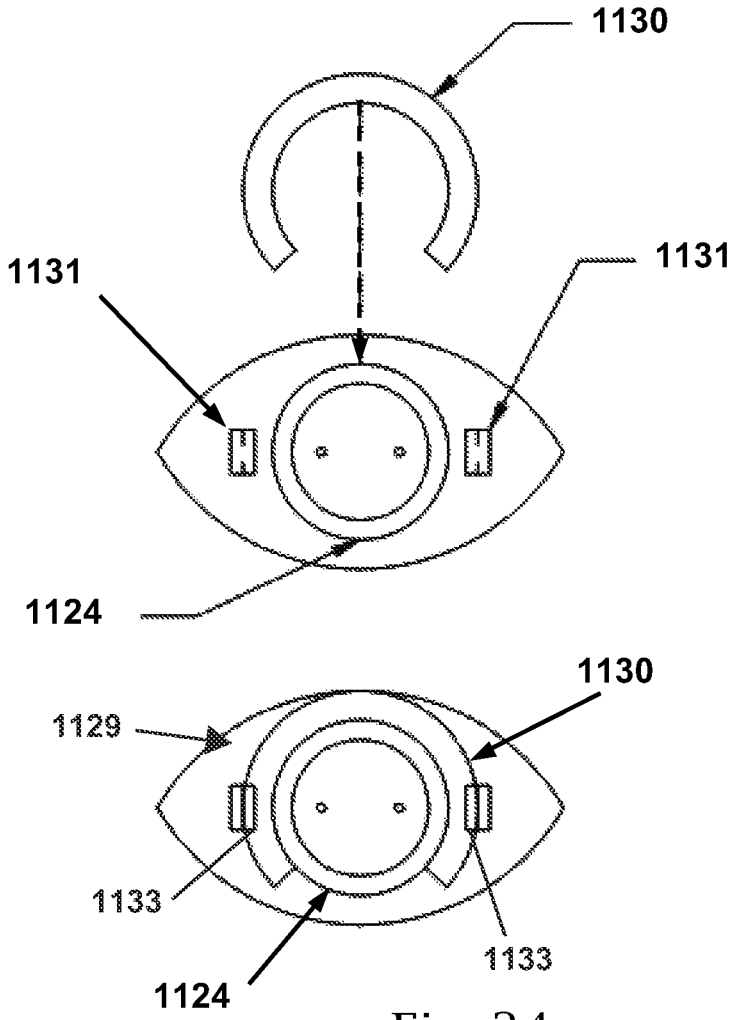
FIG. 34 is an embodiment of a coupling system for a lighting module according to the present disclosure.

FIG. 34 shows one way in which an adapter 1102 may be reversibly coupled to a reflector 1108 with a coupling system 1129. As shown in the Figure, a key 1130 may be used to lock the adapter 1102 into a semi-fixed relationship with a pair of bracket posts 1131 on a reflector 1108. To couple the adapter and the reflector, the adapter may be positioned in an opening at an end of the reflector having one or more bracket posts. The adapter may, for example, be inserted into the opening until its lock ring 1124 is substantially flush with one end of the reflector (as seen in side view in FIG. 31). Once the adapter is in place, the key 1130 may be slid or clipped into place with the bracket posts 1131.

In a typical embodiment, the bracket posts 1131 may each include a slot 1133 of substantially the same depth as the thickness of key 1130. The slots 1133 may be formed in the bracket posts at a distance away from the end of the reflector 1108 that is just slightly greater than the thickness of lock ring

1124 on the adapter. As well, the diameter of the lock ring 1124 may be greater than the diameter of the opening in the end of the reflector, and greater than the opening in the key (though likely less than the distance between the bracket posts). Thus, once the adapter is inserted into the reflector, and the key is put into place in the bracket posts, the adapter is prevented from escaping longitudinally (i.e. along the rotational axis 1114) from the reflector opening, but is still free to rotate relative to the reflector. This allows the reflector, as noted above, to be, rotated to an desired position while keeping it coupled to the adapter and, thus, its attached lamp.

Finally, as seen in FIGS. 33B-C, the adapter may include a support clip 1132. The support clip may be provided on the adapter as a way to solidify the connection between the adapter 1102 and the lamp 1106 to which it is coupled. Thus, not all the stress of coupling between the adapter and lamp will be borne by the electrical connections (e.g. the mini bi-pins); much of the coupling stress may be taken by the support clip, which may be integral with the body of the adapter. The support clip may be adjustable, or it may have a fixed size. In some embodiments, the end of the lamp having electrical connections could be inserted longitudinally through the opening of the support clip, while in other embodiments, the lamp may be partially inserted into the electrical connections and then the support clip rotated downward to clip onto the lamp.

While the invention has been described in connection with what is presently considered the most practical and preferred embodiment(s), it is to be understood that the invention is not limited to the disclosed embodiment(s) but, on the contrary is intended to cover various modifications and equivalent arrangements included within the scope of the appended claims.

I claim:

1. A lighting apparatus comprising:

a base;

a reflector rotatably coupled to the base and having a substantially paraboloid reflective exterior surface partially enclosing an interior space and defining a focal point within the interior space; and a light source disposed at least partially within the interior space and substantially at the focal point of the reflective exterior surface, wherein the light source is insertably and electrically coupled to the base;

wherein the base:

includes a plurality of electrical connections, and wherein a first set of electrical connections having a first size factor is configured to couple to the light source, and a second set of electrical connections having a second size factor is configured to couple to a light fixture;

is configured to be removably coupled to the reflector;

is configured to at least partially insert into an opening in the reflector; and is configured to be coupled to the reflector by a key and at least one bracket post, and wherein the base is configured to be rotatable relative to the reflector when coupled to the reflector.

2. The lighting apparatus of claim 1, wherein the reflector extends along a longitudinal axis of the light source.

3. The lighting apparatus of claim 1, wherein the base includes a transformer configured to alter a characteristic of electrical power flowing through the base to the light source.

4. The lighting apparatus of claim 3, wherein the base further includes a dimmer control configured to alter a characteristic of electrical power flowing through the base to the light source.

5. The lighting apparatus of claim 1, wherein the base includes a support clip configured to reversibly physically couple to the light source when the light source and the base are in electrical communication.

6. A lighting module comprising:

an adapter including:

a first set of electrical connections having a first size factor configured to couple to a light source;

a second set of electrical connections having a second size factor configured to couple to a light fixture;

transformer configured to alter a characteristic of electrical power flowing through the adapter to the light source; and a reflector rotatably coupled to the adapter and having a substantially paraboloid reflective exterior surface partially enclosing an interior space and defining a focal point within the interior space, wherein the adapter is configured to be removably and rotatably coupled to the reflector;

wherein:

the lighting module is configured to be removably coupled to the reflector;

the adaptor is configured to at least partially insert into an opening in the reflector; and the adaptor is configured to be coupled to the reflector by a key and at least one bracket post, and wherein the adaptor is configured to be rotatable relative to the reflector when coupled to the reflector.

7. The lighting module of claim 6, wherein the first set of electrical connections and the second set of electrical connections are physically incompatible.

8. The lighting module of claim 6, wherein the transformer includes a dimmer control configured to alter a characteristic of electrical power flowing between the second set of electrical connections and the first set of electrical connections.

9. The lighting module of claim 8, wherein the dimmer control includes a dimmer knob configured to modulate finely the action of the dimmer control.

10. The lighting module of claim 8, wherein the dimmer control includes a dimmer knob configured to modulate the action of the dimmer control by selection of discrete dimmer levels.

11. The lighting module of claim 6, wherein the adaptor includes a support clip configured to reversibly physically couple to the light source when the light source and the adapter are, in electrical communication.

12. The lighting nodule of claim 6, wherein the first group of electrodes includes at least one female mini pin electrode, and wherein the second group of electrodes includes at least one medium pin electrode.

* * * * *